US009556645B2

(12) United States Patent
Yoon et al.

(10) Patent No.: US 9,556,645 B2
(45) Date of Patent: Jan. 31, 2017

(54) APPARATUS FOR OPENING AND CLOSING FRONT ENTRANCE

(71) Applicants: Byungman Yoon, Goyang, Gyeonggi-do (KR); Eunsook Lee, Goyang, Gyeonggi-do (KR); Chaehi Yoon, Goyang, Gyeonggi-do (KR); Chaeho Yoon, Goyang, Gyeonggi-do (KR)

(72) Inventors: Byungman Yoon, Gyeonggi-do (KR); Eunsook Lee, Gyeonggi-do (KR); Chaehi Yoon, Gyeonggi-do (KR)

(73) Assignees: Byungman Yoon, Gyeonggi-do (KR); Eunsook Lee, Gyeonggi-do (KR); Chaehi Yoon, Gyeonggi-do (KR); Chaeho Yoon, Gyeonggi-do (KR)

( * ) Notice: Subject to any disclaimer, the term of this patent is extended or adjusted under 35 U.S.C. 154(b) by 144 days.

(21) Appl. No.: 14/498,731

(22) Filed: Sep. 26, 2014

(65) Prior Publication Data

US 2015/0013401 A1 Jan. 15, 2015

Related U.S. Application Data

(63) Continuation-in-part of application No. PCT/KR2013/002834, filed on Apr. 5, 2013.

(30) Foreign Application Priority Data

Apr. 5, 2012 (KR) ..... 10-2012-0035512
Apr. 5, 2012 (KR) ..... 10-2012-0035513

(51) Int. Cl.
*E05B 13/10* (2006.01)
*E05B 1/00* (2006.01)
(Continued)

(52) U.S. Cl.
CPC ..... *E05B 1/0038* (2013.01); *E05B 1/0053* (2013.01); *E05B 13/105* (2013.01); *E05B 59/00* (2013.01);
(Continued)

(58) Field of Classification Search
CPC ..... E05B 1/00; E05B 1/0038; E05B 1/0053; E05B 13/00; E05B 13/10; E05B 13/105; E05B 63/22; E05C 1/00; E05C 1/12; E05C 1/14
See application file for complete search history.

(56) References Cited

U.S. PATENT DOCUMENTS 2,124,099 A * 7/1938 Zagrzejewski ..... E05C 1/14 292/170
2,504,483 A * 4/1950 Abraham ..... E05C 1/14 292/153
(Continued)

FOREIGN PATENT DOCUMENTS

KR 100909560 7/2009
KR 100921200 10/2009
(Continued)

*Primary Examiner* — Christopher Boswell
(74) *Attorney, Agent, or Firm* — Lucas & Mercanti, LLP

(57) ABSTRACT

Disclosed herein is an apparatus for opening and closing a front entrance. The apparatus includes: a door lock housing which has an opening in which a latch bolt is disposed; first and second door handles which are provided on the door and configured to be pushed or pulled; a movable member which is disposed in the door lock housing and horizontally moved by pushing or pulling either the first door handle or the second door handle, with a lift guide block provided on the movable member; a rotating unit which includes a roller and a bent part; a latch bolt coupling unit which is locked to the bent part of the rotating unit and coupled to the latch bolt;
(Continued)

and a restoring spring which is configured such that the rotating unit is returned to its original state.

20 Claims, 16 Drawing Sheets

(51) Int. Cl.

| | |
|---|---|
| ***E05B 59/00*** | (2006.01) |
| ***E05B 63/22*** | (2006.01) |
| ***E05C 1/14*** | (2006.01) |
| ***E05C 1/16*** | (2006.01) |
| *E05C 1/00* | (2006.01) |

(52) U.S. Cl.
CPC ..... *E05B 63/22* (2013.01); *E05C 1/14* (2013.01); *E05C 1/16* (2013.01); *E05C 1/004* (2013.01); *Y10T 70/5199* (2015.04); *Y10T 292/1022* (2015.04)

(56) References Cited

U.S. PATENT DOCUMENTS

| | | | | | |
|---|---|---|---|---|---|
| 2,547,108 | A * | 4/1951 | Anderson | E05C 1/14 | 292/147 |
| 5,516,163 | A * | 5/1996 | Baker | E05C 1/14 | 292/165 |
| 5,564,759 | A * | 10/1996 | McNutt | E05B 1/0053 | 292/139 |
| 5,947,535 | A * | 9/1999 | Baker | E05C 1/12 | 292/165 |
| 6,139,072 | A * | 10/2000 | Lee | E05B 13/101 | 292/168 |
| 9,145,719 | B2 * | 9/2015 | Hartford | E05C 1/14 | |

FOREIGN PATENT DOCUMENTS

| | | |
|---|---|---|
| KR | 1020090103531 | 10/2009 |
| KR | 100940861 | 2/2010 |
| KR | 100943543 | 2/2010 |
| KR | 1020110036425 | 4/2011 |
| KR | 1020110125200 | 11/2011 |

* cited by examiner

APPARATUS FOR OPENING AND CLOSING FRONT ENTRANCE

CROSS-REFERENCE TO RELATED APPLICATIONS

This application is a continuation-in-part of PCT/KR2013/002834 filed Apr. 5, 2013, which claimed the priority of KR Patent Application No. 10-2012-0035513 filed Apr. 5, 2012, and KR Patent Application No. 10-2012-0035512 filed Apr. 5, 2012, contents of each of which are incorporated herein by reference in their entirety.

FIELD OF INVENTION

The present invention relates, in general, to apparatuses for opening and closing front entrances and, more particularly, to an apparatus for opening and closing a front entrance which is configured such that a door can be opened in such a way that a handle of the door is pushed or pulled in a direction in which the door opens, and such that the door can be locked or unlocked by rotating a locking unit installed in the handle.

BACKGROUND OF INVENTION

Prior Art Document

Korean Patent Registration No. 10-0909560 (Publication date: Jul. 27, 2009)

Korean Patent Registration No. 10-0934781 (Publication date: Dec. 31, 2009)

Generally, door lock devices are widely used in dwellings or public buildings. For representative example, such door lock devices are used in doors for entrances, that is, front doors, safes of banks, access control systems for limiting access to special sites, etc.

Conventional door lock devices are embodied in such a way that rotating handles are respectively provided on both surfaces of a door, and a latch interlocked with the handles is elastically installed in the door and retractably ejected from a side surface of the door. When a user holds one of the handles with his or her hand and rotates it, the latch is pulled into the door. In this state, when the door is pushed or pulled, it opens.

However, the conventional door lock devices are disadvantageous in that the user must rotate the handle before pushing or pulling the door to open the door. That is, to open a door that has been closed, two successive operations of rotating the handle in one direction and pushing or pulling the door are required.

Particularly, for children, the elderly, and disabled persons, etc., it may be difficult to rotate the handle and pass through the door. Furthermore, if the user is using both hands to hold objects, he or she must put down at least one of the objects or have help from others. Without help the user must pick up the object again after opening the door and then pass through the door.

For doors used in places such as public offices or venues which are crowded, if the door handles are operated in a pushing or pulling fashion rather than in a rotating fashion, the doors could easily open, and an accident could be prevented. Particularly, in case of a fire, if the door handles melt in the fire, it may be impossible to rotate the door handles. However, if such a door handle is operated in a pushing or pulling fashion, an accident could be prevented because of the simple operation principle of the door handle.

SUMMARY OF INVENTION

Accordingly, the present invention has been made keeping in mind the above problems occurring in the prior art, and an object of the present invention is to provide an apparatus for opening and closing a front entrance which is operated in such a way that when pushing or pulling a handle of a door in a direction of opening of the door, a user can sense the opening of the door due to rolling motion of a roller.

Another object of the present invention is to provide an apparatus for opening and closing a front entrance which is configured such that not only a user who is indoors or outdoors can easily and reliably lock a door lock device but he or she can also easily and reliably unlock the door lock device when necessary, and which has a simple structure and is able to precisely and reliably lock and unlock the door lock device.

DETAILED DESCRIPTION OF INVENTION

In order to accomplish the above objects, in an aspect, the present invention provides an apparatus for opening and closing a front entrance, including: a door lock housing having in a side surface thereof a first opening in which a latch bolt is disposed, the door lock housing being installed in a door in such a way that the first opening is exposed out of an outer surface of the door; first and second door handles respectively provided on first and second surfaces of the door, each of the first and second door handles being configured to be pushed or pulled; a movable member disposed in the door lock housing and coupled at respective opposite ends thereof to the first and second door handles, the movable member being horizontally moved by pushing or pulling either the first door handle or the second door handle, with a lift guide block provided on a medial portion of an upper surface of the movable member, the lift guide block guiding upward movement of a roller; a rotating unit disposed across an upper surface of the movable member, the rotating unit being coupled at a first end thereof to a hinge shaft, with the roller provided in a lower surface of a medial portion of the rotating unit, the roller making contact with the lift guide block, the rotating unit including a bent part on a second end thereof, wherein when the movable member is horizontally moved, the rotating unit is rotated around the hinge shaft by the roller moving upwards along the lift guide block; a latch bolt coupling unit locked at a first end thereof to the bent part of the rotating unit and coupled at a second end thereof to the latch bolt disposed in the first opening, the latch bolt coupling unit being moved to leftwards or rightwards depending on a direction of the rotation of the rotating unit; and a restoring spring wrapped around the hinge shaft, the restoring spring fixed at a first end thereof to an inner surface of the door lock housing and fixed at a second end thereof to the rotating unit so that the rotating unit is returned to an original state thereof by the restoring spring.

The lift guide block may include an inclined surface having an upwardly curved shape so that the roller rolls on the inclined surface and moves upwards.

Furthermore, until the lift guide block of the movable member begins to push the roller, the first and second door handles may be easily pushed or pulled, and when the lift guide block pushes the roller so that the roller rolls and moves upwards along the inclined surface of the lift guide block, a speed at which the first and second door handles are pushed or pulled may be reduced.

Each of the first and second door handles may include: a mounting bracket fixed to a corresponding one of the first and second surfaces of the door, the mounting bracket having a receiving space in which a first end of a grip part is disposed so as to be movable forwards or backwards; and the grip part inserted at the first end thereof into the receiving space of the mounting bracket, the grip part being configured to be pushed or pulled.

The rotating unit may include: a pair of links having in a first end thereof a hinge coupling hole, with the bent part provided on a second end of the pair of links, the bent part being bent at a predetermined position to have a downward inclined surface extending from a first end of the bent part to the predetermined position and an upward inclined surface extending from the predetermined position to a second end of the bent part; the hinge shaft coupled to the hinge coupling hole of the pair of links spaced apart from each other by a predetermined distance; a connection part connecting medial portions of the pair of links to each other, with coupling surfaces bent downwards from respective opposite ends of the connection part; and the roller coupled to the coupling surfaces of the connection part by a hinge.

In addition, a roller pin may be provided on an outer surface of the first end of the latch bolt coupling unit and placed on the bent part of the pair of links of the rotating unit so as to be movable along the inclined surface of the bent part.

The apparatus may further include: first and second locking units respectively installed in the first and second door handles; an actuating shaft disposed in the door lock housing, the actuating shaft coupled at a first end thereof to the first locking unit and coupled at a second end thereof to the second locking unit so that the actuating shaft is rotated leftwards or rightwards by manipulating the first or second locking unit; a rotating lever coupled to the actuating shaft and disposed in the door lock housing, the rotating lever being rotated leftwards or rightwards by the rotation of the actuating shaft; and an opening and closing member moved leftwards or rightwards in conjunction with the rotation of the rotating lever; and a dead bolt coupled at a first end thereof to the opening and closing member, the dead bolt being disposed at a second end thereof in a second opening formed in the side surface of the door lock housing.

The actuating shaft may have a rectangular cross-section, and the rotating lever may have in a central portion thereof a rectangular hole into which the actuating shaft is fitted so that when the actuating shaft rotates, the rotating lever is rotated along with the actuating shaft.

The opening and closing member may have: a guide slot in a central portion thereof, the guide slot extending a predetermined length in a longitudinal direction of the opening and closing member, with a support pin disposed in the guide slot, the support pin protruding from an inner surface of the door lock housing; a locking depression formed at a predetermined position in an upper edge of the opening and closing member so that the rotating lever is locked to the locking depression; and locking notches respectively formed in opposite side edges of the locking depression so that the rotating lever, when rotating, is locked to either of the locking notches and prevented from being removed from the locking depression.

Elastically supporting the rotating lever, a tension spring may be wrapped around the support pin.

Each of the first and second locking units may comprise a key assembly into which a key is inserted, or a manipulation lever.

In another aspect, the present invention provides an apparatus for opening and closing a front entrance, including: a door lock housing having in a side surface thereof a first opening in which a latch bolt is disposed, the door lock housing being installed in a door in such a way that the first opening is exposed out of an outer surface of the door; first and second door handles respectively provided on first and second surfaces of the door lock housing, each of the first and second door handles being configured to be pushed or pulled; a movable member disposed in the door lock housing and coupled at respective opposite ends thereof to the first and second door handles, the movable member being horizontally moved by pushing or pulling either the first door handle or the second door handle, with a lift guide block provided on a medial portion of an upper surface of the movable member, the lift guide block guiding upward movement of a roller; a rotating unit coupled at a medial portion thereof to a rotation shaft, the rotation shaft fixed in place and oriented in a direction parallel to the movable member, with the roller provided in a first end of the rotating unit, the roller making contact with the lift guide block, and with a locking stop provided on a second end of the rotating unit, wherein when the movable member is horizontally moved, the rotating unit is rotated around the rotation shaft; an actuating member locked at a first end thereof to the locking stop of the rotating unit and coupled at a second end thereof to the latch bolt disposed in the first opening, the actuating member being moved to leftwards or rightwards depending on a direction of the rotation of the rotating unit; and a restoring spring wrapped around the rotation shaft of the rotating unit, the restoring spring fixed at a first end thereof to an inner surface of the door lock housing and fixed at a second end thereof to the second end of the rotating unit so that the rotating unit is returned to an original state thereof by the restoring spring.

The lift guide block may include an inclined surface having an upwardly curved shape so that the roller rolls on the inclined surface and moves upwards.

Furthermore, until the lift guide block of the movable member begins to push the roller, the first and second door handles may be easily pushed or pulled, and when the lift guide block pushes the roller so that the roller rolls and moves upwards along the inclined surface of the lift guide block, a speed at which the first and second door handles are pushed or pulled may be reduced.

Each of the first and second door handles may include: a mounting bracket fixed to a corresponding one of the first and second surfaces of the door, the mounting bracket having a receiving space in which a first end of a grip part is disposed so as to be movable forwards or backwards; and the grip part inserted at the first end thereof into the receiving space of the mounting bracket, the grip part being configured to be pushed or pulled.

The rotating unit may include: a pair of links spaced apart from each other by a predetermined distance, with a coupling hole formed in a medial portion of each of the links so that the links are coupled to the rotation shaft through the coupling holes; bent parts respectively provided on the first ends of the links and bent in a direction parallel to a direction in which the lift guide block moves, with the roller coupled to the bent parts by a hinge; and a connection part connecting the second ends of the links to each other, with the locking stop connected to the connection part, the locking stop being bent downwards.

The actuating member may have: a locking slot formed in a bottom surface of a first end of the actuating member so that the locking stop of the rotating unit is locked to the locking slot; and guide slots formed in respective opposite side surfaces of the actuating member, with a stopper coupled to the guide slots, the stopper being used in limiting rotation of the locking stop.

The apparatus may further include: first and second locking units respectively installed in the first and second door handles; an actuating shaft disposed in the door lock housing, the actuating shaft coupled at a first end thereof to the first locking unit and coupled at a second end thereof to the second locking unit so that the actuating shaft is rotated leftwards or rightwards by manipulating the first or second locking unit; a rotating lever coupled to the actuating shaft and disposed in the door lock housing, the rotating lever being rotated leftwards or rightwards by the rotation of the actuating shaft; an opening and closing member moved leftwards or rightwards in conjunction with the rotation of the rotating lever; and a dead bolt coupled at a first end thereof to the opening and closing member, the dead bolt being disposed at a second end thereof in a second opening formed in the side surface of the door lock housing.

The actuating shaft may have a rectangular cross-section, and the rotating lever may have in a central portion thereof a rectangular hole into which the actuating shaft is fitted so that when the actuating shaft rotates, the rotating lever is rotated along with the actuating shaft.

The opening and closing member may have: a guide slot in a central portion thereof, the guide slot extending a predetermined length in a longitudinal direction of the opening and closing member, with a support pin disposed in the guide slot, the support pin protruding from an inner surface of the door lock housing; a locking depression formed at a predetermined position in an upper edge of the opening and closing member so that the rotating lever is locked to the locking depression; and locking notches respectively formed in opposite side edges of the locking depression so that the rotating lever, when rotating, is locked to either of the locking notches and prevented from being removed from the locking depression.

Elastically supporting the rotating lever, a tension spring may be wrapped around the support pin.

Each of the first and second locking units may comprise a key assembly into which a key is inserted, or a manipulation lever.

In an apparatus for opening and closing a front entrance according to the present invention, the operation of a door lock makes it possible for a user to sense that the door is opening. Therefore, the safety in opening or closing the door and convenience in use can be markedly enhanced.

Furthermore, the user has only to push or pull a door handle in a direction of opening of the door to open the door. Therefore, even children, the elderly, and disabled persons, or a user who is using both hands to hold objects, can easily open the door. Thus, convenience in use and practicality can be improved.

In addition, the opening and closing apparatus has a simple structure and is able to precisely and reliably lock and unlock the door. Hence, it is very easy to lock or unlock the door, and there is no possibility of the locking or unlocking operation causing a malfunction of the apparatus. The reliability of the opening and closing apparatus can be enhanced by virtue of the accurate locking and unlocking operation.

Moreover, the opening and closing apparatus is operated in a pushing or pulling fashion rather than in a rotating fashion. Therefore, for places such as public offices or venues which are crowded, an accident can be prevented because it is easy to open the door. Particularly, in case of a fire, if a handle of the door melts in the fire, it may be impossible to rotate the door handle. However, in the present invention, because the apparatus can be easily operated in a pushing fashion, the risk of an accident can be markedly reduced.

DESCRIPTION OF THE REFERENCE NUMERALS IN THE DRAWINGS

Figure 1:
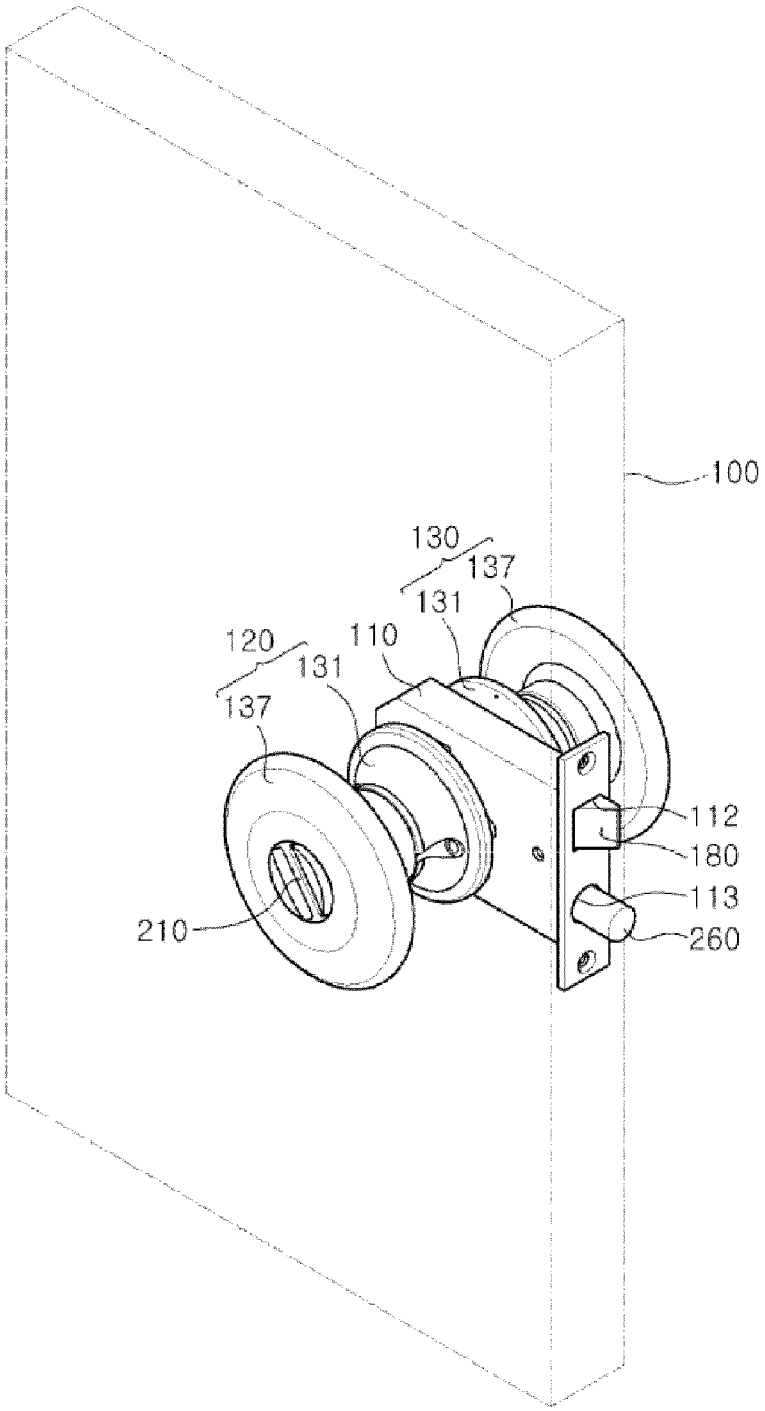
FIG. 1 is a perspective view showing the outer shape of an apparatus for opening and closing a front entrance, according to the present invention.

100: door 110: door lock housing
110*a*: main body 110*b*: cover
110*c*: fastener 111: passing depression
112: first opening 113: second opening
120, 130: first, second door handle
131: mounting bracket
132: receiving space 133: guide hole
134: hole 135: through hole
136: fixing protrusions 137: grip part
138: insert depression 140: movable member
141: lift guide block 142: inclined surface
150: rotating unit 151: hinge coupling hole
152: bent part 153: link
154: hinge shaft 155: coupling surface
156: connection part 157: roller
158: removal prevention stop

160: latch bolt coupling unit
161: roller pin 170: restoring spring
175: elastic spring 180: latch bolt
210, 220: first, second locking unit
230: actuating shaft
240: rotating lever 241: hole
242: protruding piece 243: guide groove
250: opening and closing member
251: guide hole
252: support pin 253: locking depression
254: locking notch 255: tension spring
260: dead bolt
100*a*: door 110*a*: door lock housing
110*d*: main body 110*e*: cover
110*f*: fastener 111*a*: passing depression
112*a*: first opening 113*a*: second opening
120*a*, 130*a*: first, second door handle
131*a*: mounting bracket
132*a*: receiving space 133*a*: guide hole
134*a*: hole 135*a*: through hole
136*a*: fixing protrusion 137*a*: grip part
138*a*: insert depression 140*a*: movable member
141*a*: lift guide block 142*a*: inclined surface
143*a*: stepped portion 150*a*: rotating unit
151*a*: rotation shaft 152*a*: coupling hole
153*a*: link 154*a*: bent part
155*a*: connection part 156*a*: roller
157*a*: locking stop 160*a*: actuating member
161*a*: locking slot 162*a*: guide slot
163*a*: stopper 164*a*: protrusion
165*a*: elastic spring 170*a*: restoring spring
180*a*: latch bolt
210*a*, 220*a*: first, second locking unit
230*a*: actuating shaft 240*a*: rotating lever
241*a*: hole 242*a*: protruding piece
243*a*: guide groove 250*a*: opening and closing member
251*a*: support pin 252*a*: guide hole
253*a*: locking depression 254*a*: locking notch
255*a*: tension spring 260*a*: dead bolt

EXAMPLES

The above and other objects, features and advantages of the present invention will be more clearly understood from the following detailed description taken in conjunction with the accompanying drawings. Hereinafter, an apparatus for opening and closing a front entrance according to the present invention will be described in detail with reference to the attached drawings. The same reference numerals are used throughout the different drawings to designate the same or similar components, unless specifically mentioned otherwise.

<First Embodiment>

Figure 2:
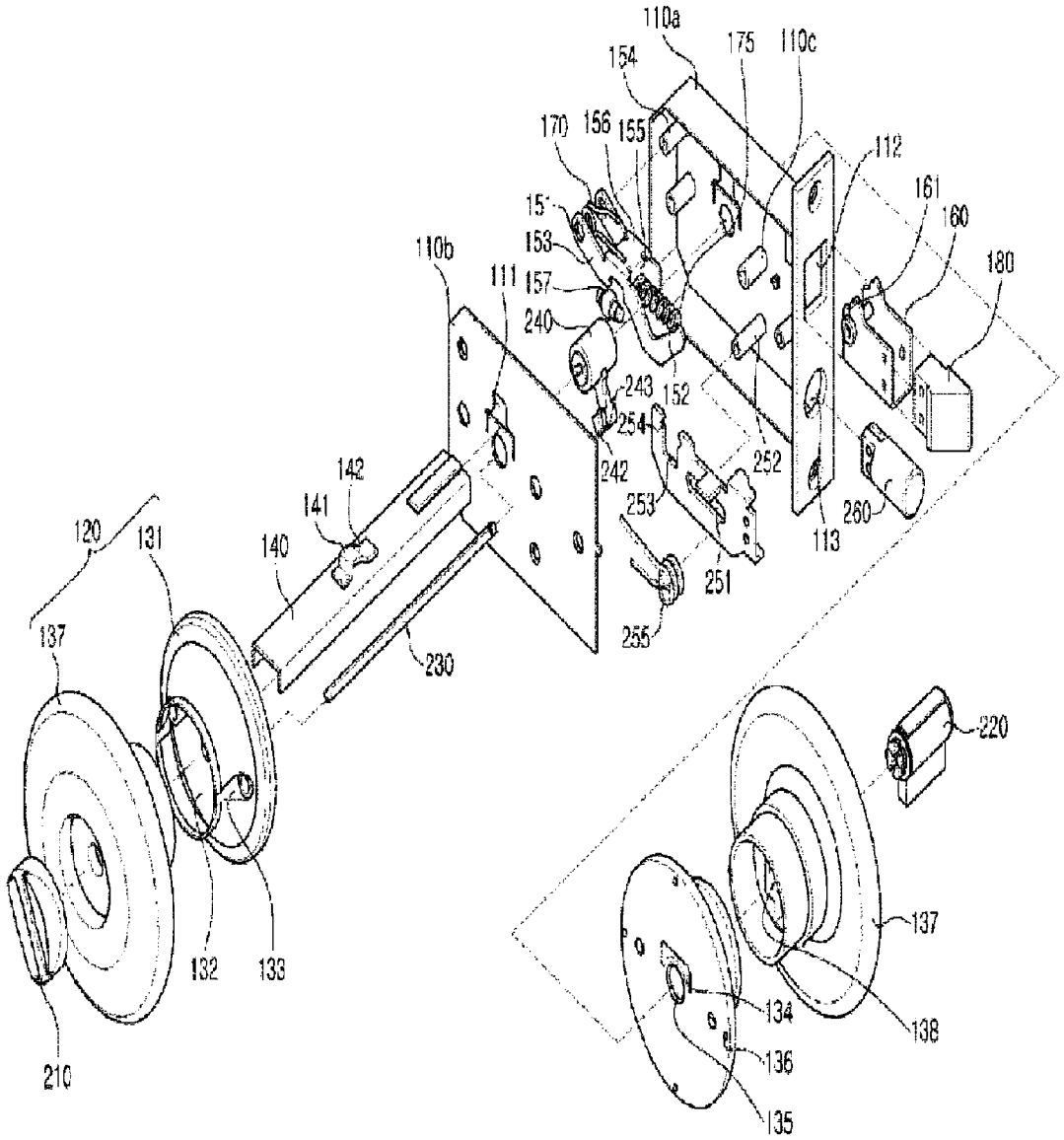
FIG. 2 is an exploded perspective view of the apparatus according to the present invention.
Figure 3:
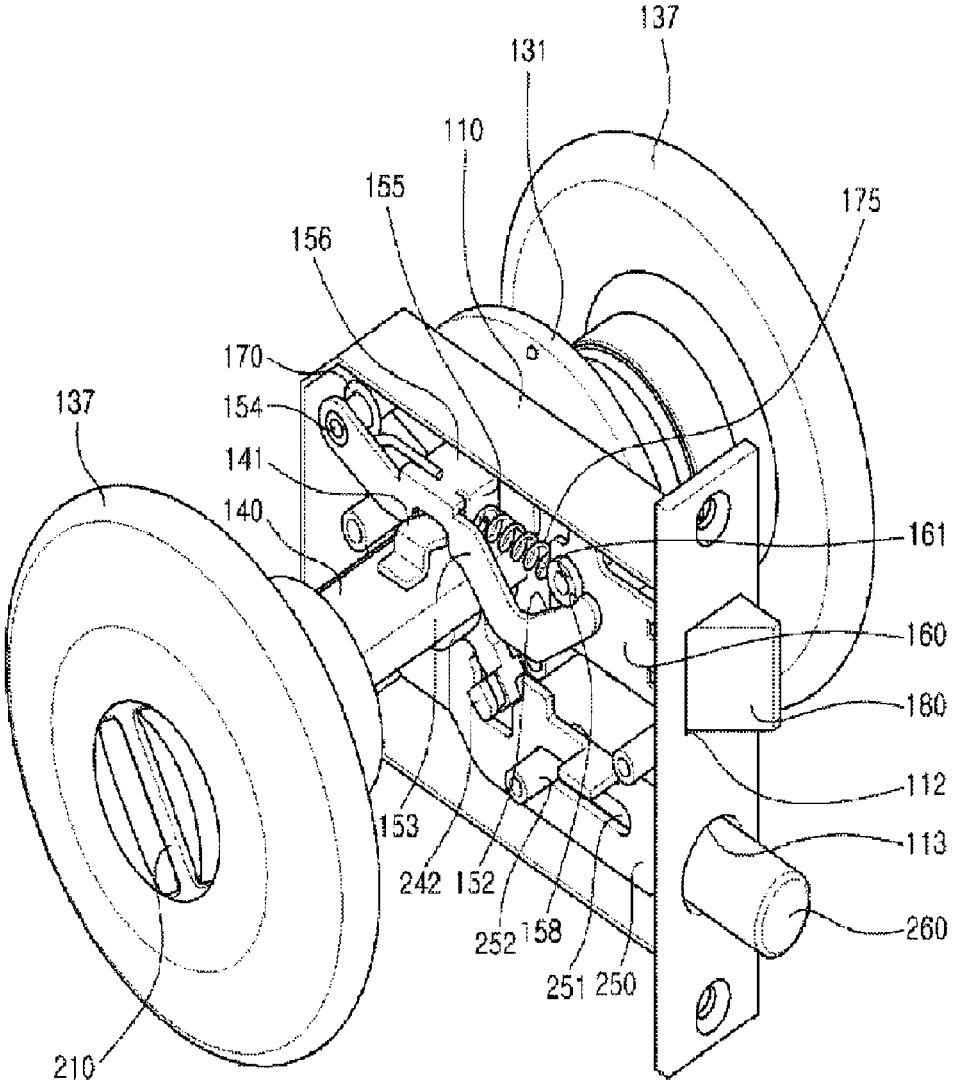
FIG. 3 is a perspective view illustrating critical parts of the apparatus according to the present invention.
Figure 4:
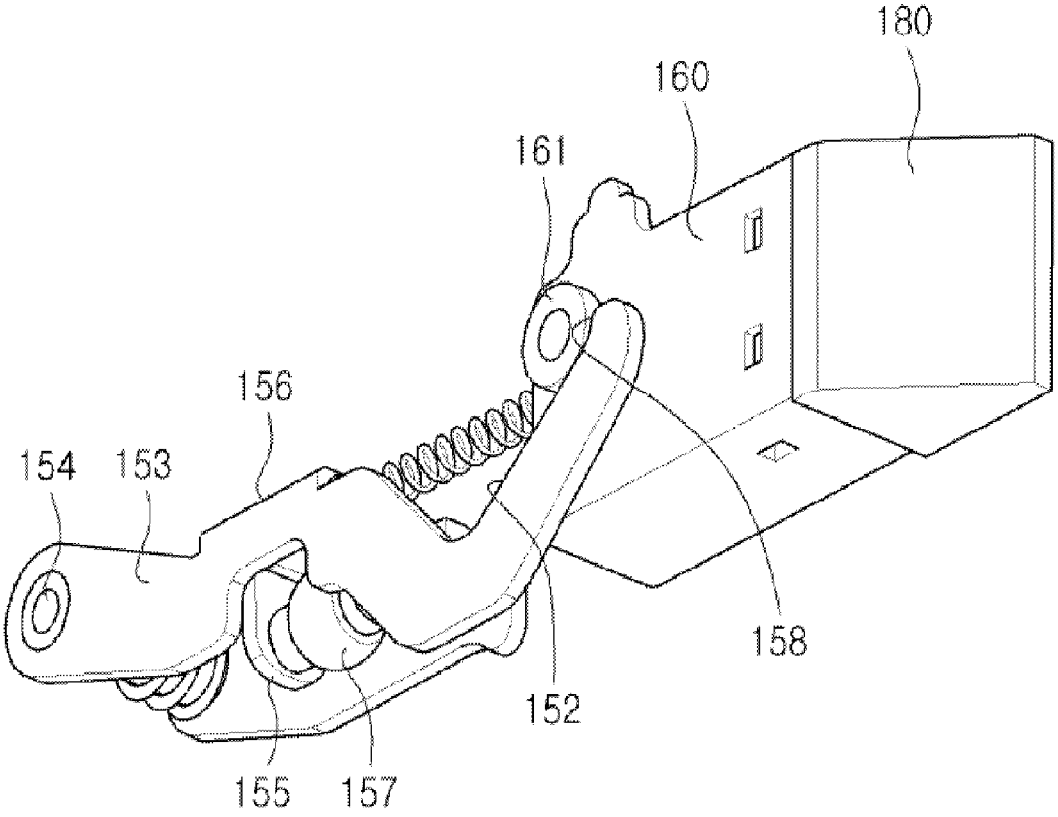
FIG. 4 is a view illustrating a rotating unit and a latch bolt coupling unit of the apparatus according to the present invention.

FIG. 1 is a perspective view showing the outer shape of an apparatus for opening and closing a front entrance, according to the present invention. FIG. 2 is an exploded perspective view of the opening and closing apparatus according to the present invention. FIG. 3 is a perspective view illustrating critical parts of the opening and closing apparatus according to the present invention. FIG. 4 is a view illustrating a rotating unit and a latch bolt coupling unit of the opening and closing apparatus according to the present invention.

The apparatus for opening and closing the front entrance according to the present invention includes a first part which is used to embody the operation of opening or closing a door in such a way that when a handle is pushed or pulled the door opens, and when the handle is released the door closes, and a second part which is used to embody the operation of locking or unlocking the door in such a way as that a locking unit installed in the handle is rotated.

First, the first part which is used to embody the operation of opening or closing the door in such a way that when the handle is pushed or pulled the door opens, and when the handle is released the door closes will be described with reference to the attached drawings.

As shown in FIG. 1 through 4, the apparatus for opening and closing the front entrance according to the present invention includes a door lock housing 110, first and second door handles 120 and 130, a movable member 140, a rotating unit 150, a latch bolt coupling unit 160 and a restoring spring 170.

The door lock housing 110 includes a main body 110*a* which is open on a surface thereof and receives the rotating unit 150 and latch bolt coupling unit 160 therein, and a cover 110*b* which covers the open surface of the main body 110*a*. The main body 110*a* and the cover 110*b* are coupled to each other by a plurality of fasteners 110*c*.

The door lock housing 110 has a movable-member passing hole 111 which is formed in central portions of the cover 110*b* and the main body 110*a*. The door lock housing 110 has, in a side surface thereof, a first opening 112 in which a latch bolt 480 is retractably disposed, and a second opening 113 in which a dead bolt 260 is retractably disposed. The door lock housing 110 is installed in the door 100 in such a way that the first and second opening 112 and 113 are exposed to the outside from the side surface of the door 100.

The first and second door handles 120 and 130 are respectively installed on first and second surfaces of the door 100 in which the door lock housing is installed.

Each door handle 120, 130 includes a mounting bracket 131 which is coupled to the door 100, and a grip part 137 which is inserted into the mounting bracket 131 and configured to be pushed and pulled.

The mounting bracket 131 has a receiving space 132 in which a first end of the grip part 137 is disposed so as to be movable forwards and backwards. Guide holes 133 are formed in the mounting bracket 131 on opposite sides of the receiving space 132. Communicating with the receiving space 132, a hole 134 is formed in a central portion of a surface of the mounting bracket 131 that makes contact with the door 100. A through hole 135 is formed in the mounting bracket 131 below the hole 134. The hole 134 has the same shape as that of a movable member 140 so that the movable member 140 is inserted into the hole 134. The through hole 135 has an appropriate size to dispose therein an actuating shaft 230 which will be explained in detail in the decription of the second part. A plurality of fixing protrusions 136, each of which has a pointed shape, are provided around the hole 135 and the through hole 135 and pegged into the corresponding surface of the door 100. Pegged into the surface of the door 10 that makes contact with the mounting bracket 131, the fixing protrusions 136 function to fix the mounting bracket 131 in place.

A protrusion is provided on a central portion of a first surface of each grip part 137 and disposed in the receiving space 132 of the corresponding mounting bracket 131 so as to be movable forwards and backwards under guidance of the guide hole 133. An insert depression 138 having the same shape as that of the hole 134 of the mounting bracket 131 is formed in the grip part 137. Locking units 210 and 220 are respectively installed in the grip parts 137 at positions corresponding to the through holes 135 of the mounting brackets 131. Each of the locking units 210 and 220 comprises a key assembly or a manipulation lever. In detail, each locking unit 210, 220 is installed in the corresponding grip part 137 in such a way that a key insert slot of the key assembly or a manipulation surface of the manipulation lever is exposed to the outside through a second surface of the grip part 137 to allow a user to manipulate the locking unit 210, 220.

A first end of the movable member 140 which has a reverse U-shaped cross-section passes through the hole 134 formed in the mounting bracket 131 of the first door handle 120 and is inserted into the insert depression 138 of the corresponding grip part 137. A second end of the movable member 140 passes through the through hole 111 formed in the door lock housing 110 and is inserted both into the hole 135 which is formed in the mounting bracket 131 of the second door handle 130 and into the insert depression 138 of the corresponding grip part. A lift guide block 141 is provided on a medial portion of the movable member 140. The lift guide block 141 has an inclined surface 142 which is gently curved upward.

The movable member 140 is horizontally moved by the operation of pushing or pulling the first or second door handle 120 or 130.

The rotating unit 150 includes a pair of links 153, a hinge shaft 154, a connection part 156 and a roller 157. At least one of the links 153 has a hinge coupling hole 151 in a first end thereof and includes in a second end thereof a bent part 152 which is bent at a predetermined position to have a downward inclined surface extending from a first end of the bent part 452*b* to the predetermined position and an upward inclined surface extending from the predetermined position to a second end of the bent part 452*b*. The hinge shaft 154 is coupled to the hinge coupling hole 151 with the links 153 spaced apart from each other by a predetermined distance. The connection part 156 connects medial portions of the spaced links 153 to each other and has on opposite ends thereof coupling surfaces 155 which are bent downwards. The roller 157 is coupled to the coupling surfaces 155 of the connection part 156 by a hinge.

The rotating unit 150 having the above-mentioned construction is disposed in the door lock housing 110 across the upper surface of the movable member 140 in such a way that the roller 157 can make contact with the inclined surface 142 of the lift guide block 141.

Therefore, when the movable member 140 horizontally moves in a predetermined direction, the lift guide block 141 pushes the roller 157 upwards. While pushed by the lift guide block 141, the roller 157 rolls around the hinge and moves upwards along the inclined surface 142 of the lift guide block 141. The links 153 are rotated around the hinge shaft 154 by the upward movement of the roller 157.

The latch bolt coupling unit 160 is disposed in the door lock housing 110 between the rotating unit 150 and the first opening 112 of the door lock housing. A first end of the latch bolt coupling unit 160 is connected to the rotating unit 150, and a second end thereof is coupled to the latch bolt 180 disposed in the first opening 112.

A roller pin 161 is coupled to an outer surface of the first end of the latch bolt coupling unit 160 and disposed on the bent part 152 of the corresponding link 153. Furthermore, the roller pin 161 is configured such that it can move along the inclined surface of the bent part 152. A removal prevention stop 158 is formed on the end of the bent part 152 so as to prevent the roller pin 161 from being removed from the bent part 152.

When the roller 157 of the rotating unit is placed on the upper surface of the movable member 140, the roller pin 161 is disposed on the end of the bent part 152. As the roller 157 moves upwards along the lift guide block 141 of the movable member 140 and the link 153 thus rotates around the hinge shaft 154, the bent part 152 of the link 453 is moved upwards, and the roller pin 161 is thus moved along the inclined surface to the medial portion of the bent part 152. At this time, the movement of the latch bolt coupling unit 160 causes the latch bolt 180 coupled to the latch bolt coupling unit 160 to be retracted into the door 100.

The restoring spring 170 is wrapped around the hinge shaft 154 of the rotating unit 150.

A first end of the restoring spring 170 wrapped around the hinge shaft 154 is fixed to the inner surface of the door lock housing 110, and a second end thereof is fixed to the connection part 156 of the links 153. Therefore, the restoring spring 170 is compressed by rotation of the links 153, and when the external force that has rotated the links 153 is removed, the restoring spring 170 returns to its original state so that the links 153 can be return to its pre-rotated state. In addition, an elastic spring 175 is installed between the connection part 156 and the latch bolt coupling unit 160. When the roller pin 161 of the latch bolt coupling unit 160 is moved to the medial portion of the bent part 152 by rotation of the links, the elastic spring 175 is compressed. When the links 153 move downwards and return to their original positions, the elastic spring 175 that has been compressed returns to its original state and thus pushes the latch bolt coupling unit 160 to its original position. At this time, the movement of the latch bolt coupling unit 160 causes the latch bolt 180 coupled to the latch bolt coupling unit 160 to be ejected outwards from the door 100.

Hereinafter, the operation of the first part of the opening and closing apparatus having the above-mentioned construction will be explained in detail.

Figure 5:
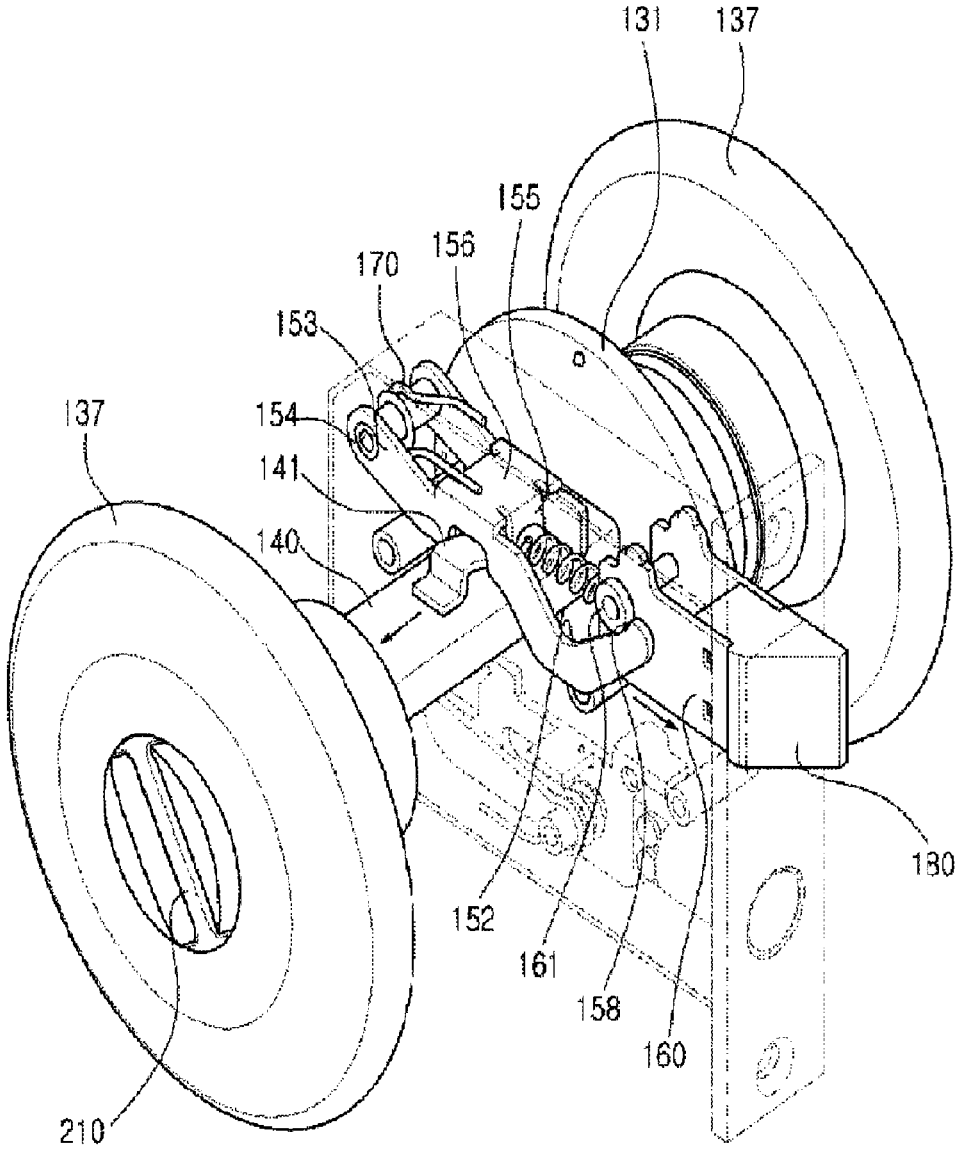
FIG. 5 is a view illustrating a door opening operation of the apparatus according to the present invention.
Figure 6:
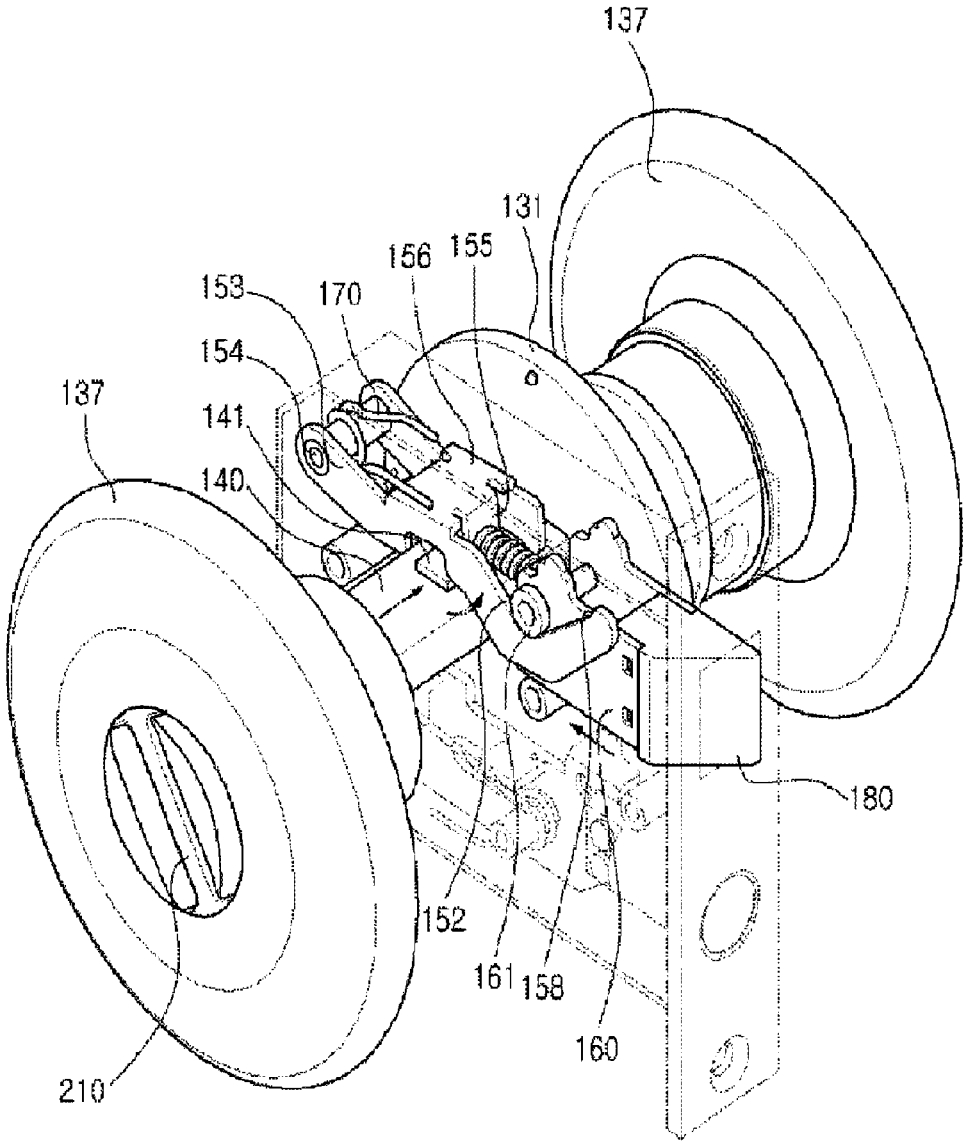
FIG. 6 is a view illustrating a door closing operation of the apparatus according to the present invention.

FIG. 5 is a view illustrating a door closing operation of the opening and closing apparatus according to the present invention, and FIG. 6 is a view illustrating a door opening operation of the opening and closing apparatus according to the present invention.

In FIGS. 5 and 6, for the convenience of understanding, only the components that are used to embody the function of the first part are illustrated by solid lines. The operation of the first part can be conducted after the door has been unlocked.

In the state of FIG. 5, external force is applied to neither the first nor second door handle 120 and 130, so that the restoring spring 170 is normally released and a front end of the latch bolt 180 is ejected outwards from the first opening 112.

As shown in FIG. 6, when the grip part 137 which is provided in the first or second door handle is pushed or pulled, the movable member 140 is horizontally moved, and the lift guide block 141 provided on the upper surface of the movable member 140 is integrally moved along with the movable member 140. At this time, the lift guide block 141 pushes the roller 157 that makes contact with the inclined surface 142. Then, the roller 157 rotates on the hinge and rolls upwards along the inclined surface 142 of the lift guide block 141 from the bottom of the inclined surface 142 to the top thereof. As the roller 157 moves upwards, the links 153 are rotated around the hinge shaft 154 so that the bent part 152 provided on the second end of the link 153 is moved upwards, whereby the inclination of the inclined surface of the bent part 152 is increased. Therefore, the roller pin 161 of the latch bolt coupling unit 160 moves along the inclined surface to the medial portion of the bent part 152. As the latch bolt coupling unit 160 moves, the latch bolt 180 is retracted into the door 100, thus allowing the door 100 to open. During the above process, the restoring spring 170 wrapped around the hinge shaft 154 is compressed by the rotation of the links 153, and the elastic spring 175 installed in the latch bolt coupling unit 160 is also compressed by the movement of the latch bolt coupling unit 160.

In the state of FIG. 6, when the grip part 137 of the first or second handle that has been pushed or pulled is released, in other words, when the external force that has been applied to the grip part 137 is removed, the movable member 140 is returned to its original position, and the roller 157 that has been moved upwards by the movement of the movable member 140 is moved downwards along the lift guide block 141. Simultaneously, the restoring spring 170 that has been compressed returns to its original state, thus returning the links 153 to their pre-rotated state. That is, the links 153 rotate around the hinge shaft 154 so that the bent part 152 provided on the second end of the links 153 are moved downwards, whereby the inclination of the inclined surface of the bent part 152 becomes reduced. Then, the roller pin 161 of the latch bolt coupling unit 160 is moved to the end of the bent part 152 along the inclined surface of the bent part 152 by the restoring force of the elastic spring 175 that has been compressed in the latch bolt coupling unit 160. Furthermore, the latch bolt coupling unit 160 is moved so that the latch bolt 180 is ejected outwards from the door 100, whereby the door 100 enters the closed state of FIG. 5.

In the above-mentioned apparatus for opening and closing the front entrance, when the user pushes the grip part 137 of the door handle in the direction in which the door 100 opens, the movable member 140 is pushed by the pushing force of the grip part 137. Here, until the lift guide block 141 of the movable member 140 begins to push the roller 157 upwards, the grip part 137 is easily pushed. While the lift guide block 141 pushes the roller 157 upwards and the roller 157 thus rolls upwards along the inclined surface of the lift guide block 141, the speed at which the grip part 137 is pushed and moved is reduced. Therefore, the user can feel in his or her hand a variation of the speed of the grip part 137, that is, a reduction in the speed at which the grip part 137 is pushed. Thus, the user can sense that the door 100 is opening. In addition, by virtue of the rolling motion of the roller 157 that moves upwards along the inclined surface 142 of the lift guide block, the user may not only be able to sense that the door 100 is opening but the door 100 can also open smoothly.

Hereinafter, the second part which is used to embody the operation of locking or unlocking the apparatus for opening and closing the front entrance in such a way that the opening and closing apparatus can be simply locked indoors or outdoors and, as needed, the locked state of the opening and closing apparatus can be released will be described with reference to the attached drawings.

As shown in FIGS. 1 through 3, the apparatus for opening and closing the front entrance according to the present invention further includes first and second locking units 210 and 220, an actuating shaft 230, a rotating lever 240, an opening and closing member 250 and a dead bolt 260. The first and second locking units 210 and 220 are respectively installed in the first and second door handles 120 and 130. The actuating shaft 230 passes through the door lock housing 110. A first end of the actuating shaft 230 is connected to the first locking unit 210 and a second end thereof is connected to the second locking unit 220. The actuating shaft 230 is rotated to the left or right by the operation of the first or second locking unit 210 or 220. The rotating lever 240 is coupled to the actuating shaft 230, disposed in the door lock housing 110, and rotated to the left or right by the rotation of the actuating shaft 230. The opening and closing member 250 is rotated to the left or right in conjunction with the rotation of the rotating lever 240. A first end of the dead bolt 260 is connected to the opening and closing member 250 and a second end of the dead bolt 260 is disposed in the second opening 113 formed in the side surface of the door lock housing 110.

Each of the first and second locking units 210 and 220 comprises a key assembly into which a key is inserted or manipulation lever. In detail, each of the first and second locking units 210 and 220 is installed in the corresponding door handle 120, 130 in such a way that a key insert slot of the key assembly or a manipulation surface of the manipulation lever is exposed to the outside through a first surface of the door handle 120, 130 to allow the user to manipulate the first or second locking unit 210 or 220.

The actuating shaft 230 which has a rectangular cross-section is disposed both in a central portion of the rotating lever 240 and in the through holes 135 of the mounting brackets 131 and coupled to the first and second locking units 210 and 220 installed in the grip parts 137.

The rotating lever 240 has in a central portion thereof a rectangular hole 241 in which the actuating shaft 230 is disposed. A protruding piece 242 for use in moving the opening and closing member 250 is provided on an end of the rotating lever 240. A guide groove 243 is formed in an outer surface of the protruding piece 242. Because of the actuating shaft 230 and the hole 241 of the rotating lever 240 are rectangular, the rotating lever 240 can be rotated along with the actuating shaft 230.

The opening and closing member 250 is disposed below the rotating lever 240. A first end of the opening and closing member 250 is coupled to the dead bolt 260 which is disposed in the second opening 113 of the door lock housing 110. Extending a predetermined length in the longitudinal direction of the opening and closing member 250, a guide hole 251 is formed in a central portion of the opening and closing member 250. Protruding from the inner surface of door lock housing 110, a support pin 252 is disposed in the guide hole 251. A locking depression 253 to which the protruding piece 242 of the rotating lever 240 is locked is formed at a predetermined position in an upper edge of the opening and closing member 250. Locking notches 254 are respectively formed in opposite side edges of the locking depression 253 so that, when rotated to the maximum, the protruding piece 242 is locked to the corresponding locking notch 254. A tension spring 255 which elastically supports the protruding piece 242 of the rotating lever 240 is wrapped around the support pin 252. Wrapped around the support pin 252, the tension spring 255 is fixed at a first end thereof to the bottom surface of the door lock housing 110 and fixed at a second end thereof to the sidewall of the door lock housing 110 via a lower surface of the guide groove 243 of the rotating lever 240.

The operation of the second part of the opening and closing apparatus having the above-mentioned construction will be explained in detail.

Figure 7:
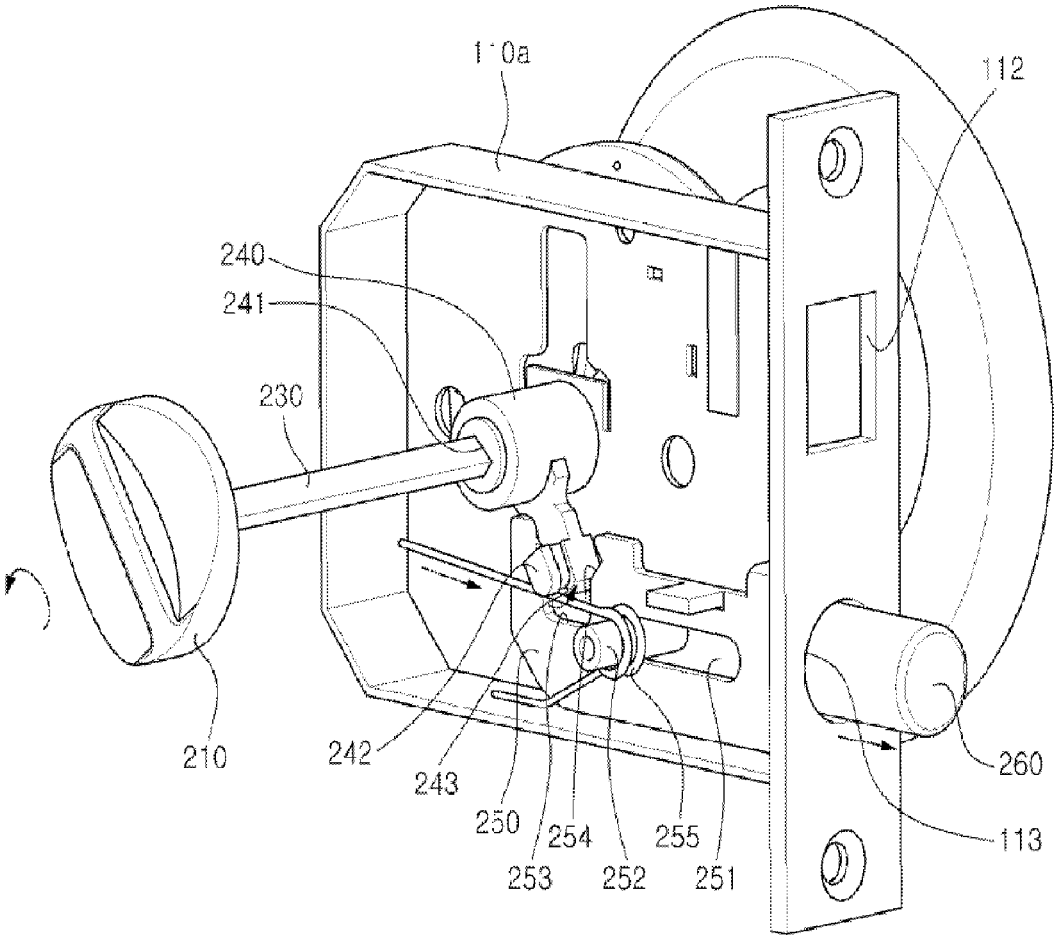
FIG. 7 is a view illustrating a locked state of the apparatus according to the present invention.
Figure 8:
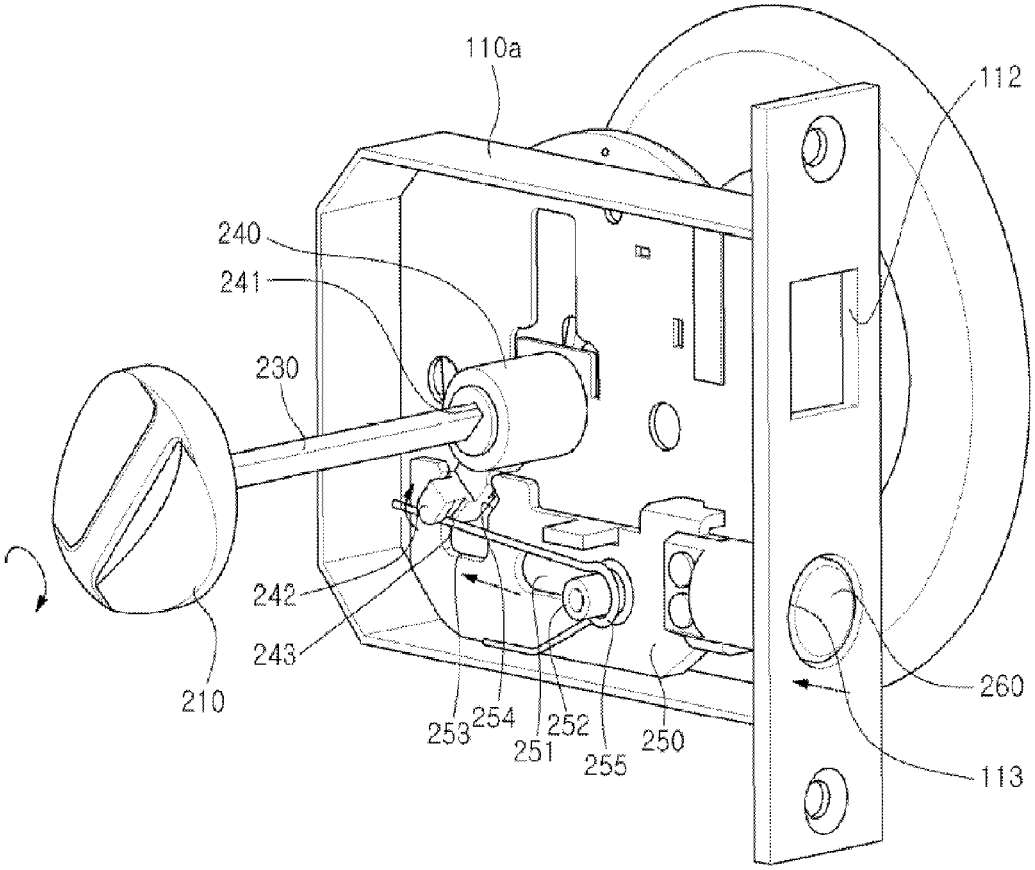
FIG. 8 is a view illustrating an unlocked state of the apparatus according to the present invention.

FIG. 7 is a view illustrating the locked state of the opening and closing apparatus according to the present invention. FIG. 8 is a view illustrating the unlocked state of the opening and closing apparatus according to the present invention. In FIGS. 7 and 8, for the convenience of understanding, only the components that are used to embody the function of the second part are illustrated.

As shown in FIG. 7, to lock the door 100 and thus prevent the door 100 from opening, the dead bolt 260 of the opening and closing apparatus must be ejected outwards from the outer surface of the door 100.

In this state, as shown in FIG. 8, to make the door 100 enter an openable state, the key is inserted into the first or second locking unit 210 or 220 provided in the first or second door handle 110 or 120 and rotated in a predetermined direction, or the manipulation lever is rotated in a predetermined direction. Then, the actuating shaft 230 which is integrally coupled to the first and second locking units 210 and 220 is rotated. The rotating lever 240 is rotated in the same direction by the rotation of the actuating shaft 230. Simultaneously, the protruding piece 242, which is provided on the end of the rotating lever 240 and disposed in the locking depression 253 of the opening and closing member 250, is also rotated, thus moving the opening and closing member 250 in a direction corresponding to the rotation of the protruding piece 242. Here, because the support pin 252 fixed to the door lock housing 110 is disposed in the guide hole 251 of the opening and closing member 250, the opening and closing member 250 is linearly moved under the guidance of the support pin 252. When the protruding piece 242 that has rotated is locked to the locking notch 254 formed in a first side edge of the locking depression 253, the rotating lever 240 no longer rotates. Furthermore, in this case, the protruding piece 242 of the rotating lever 240 is supported by the elastic force of the tension spring 255. The rotating lever 240 is therefore prevented from being reversely rotated, unless external force is applied thereto. Consequently, the opening and closing member 250 that has been moved to the door openable state can be maintained in place. The dead bolt 260 coupled to the opening and closing member 250 is retracted into the second opening 113 by the movement of the opening and closing member 250, thus allowing opening of the door 100.

Meanwhile, to lock the door 100 and thus prevent the door 100 from opening, the key is inserted into the first or second locking unit 210 or 220 and reversely rotated or the manipulation lever is reversely rotated. Then, the actuating shaft 230 and the rotating lever 240 which are integrally coupled to the first and second locking units 210 and 220 are reversely rotated. Simultaneously, the protruding piece 242, which is disposed in the locking depression 253 of the opening and closing member 250, is also reversely rotated by the rotation of the rotating lever 240, thus moving the opening and closing member 250 in a direction corresponding to the direction in which the protruding piece 242 rotates. During the above process, because the support pin 252 fixed to the door lock housing 110 is disposed in the guide hole 251 of the opening and closing member 250, the opening and closing member 250 can also linearly move under the guidance of the support pin 252. When the protruding piece 242 that has reversely rotated is locked to the locking notch 254 formed in a second side edge of the locking depression 253, the protruding piece 242 no longer rotates. Furthermore, because the protruding piece 242 of the rotating lever 240 moves the opening and closing member 250 while overcoming the elastic force of the tension spring 255 that elastically supports the protruding piece 242, the rotation of the rotating lever 240 and the movement of the opening and closing member 250 can be reliably and smoothly embodied. The dead bolt 260 coupled to the opening and closing member 250 is ejected outwards form the second opening 113 by the movement of the opening and closing member 250 and inserted into a locking recess (not shown) formed in the side frame of the entrance, so that the door enters the closed state of FIG. 7.

As described above, in the apparatus for opening and closing the front entrance according to the present invention, when a user pushes or pulls a door handle of the door after unlocking a door, he or she can easily sense that the door is opening while feeling both variation of the speed of the door handle when a roller begins to move upwards and the rolling motion of the roller, whereby the safety in opening or closing the door can be enhanced. Furthermore, the operation of opening the door can be smoothly conducted by the rolling motion so that the convenience in use can be enhanced.

In addition, the opening and closing apparatus is operated in a pushing or pulling fashion rather than in a rotating fashion. Therefore, even children, the elderly, and disabled persons, or a user who is using both hands to hold objects, can easily open the door. Thus, convenience in use and practicality can be improved.

Moreover, the operation of locking or unlocking the opening and closing apparatus can be facilitated, so that there is no possibility of failure of the apparatus in locking or unlocking the locking unit, and the reliability can be enhanced by virtue of the increased precision of the locking units.

Furthermore, the opening and closing apparatus is operated in a pushing or pulling fashion rather than in a rotating fashion. Therefore, for places such as public offices or venues which are crowded, an accident can be prevented because it is easy to open the door. Particularly, in case of a fire, if a handle of the door melts in the fire, it may be impossible to rotate the door handle. However, in the present invention, because the apparatus can be easily operated in a pushing fashion, the risk of an accident can be markedly reduced.

<Second Embodiment>

Figure 9:
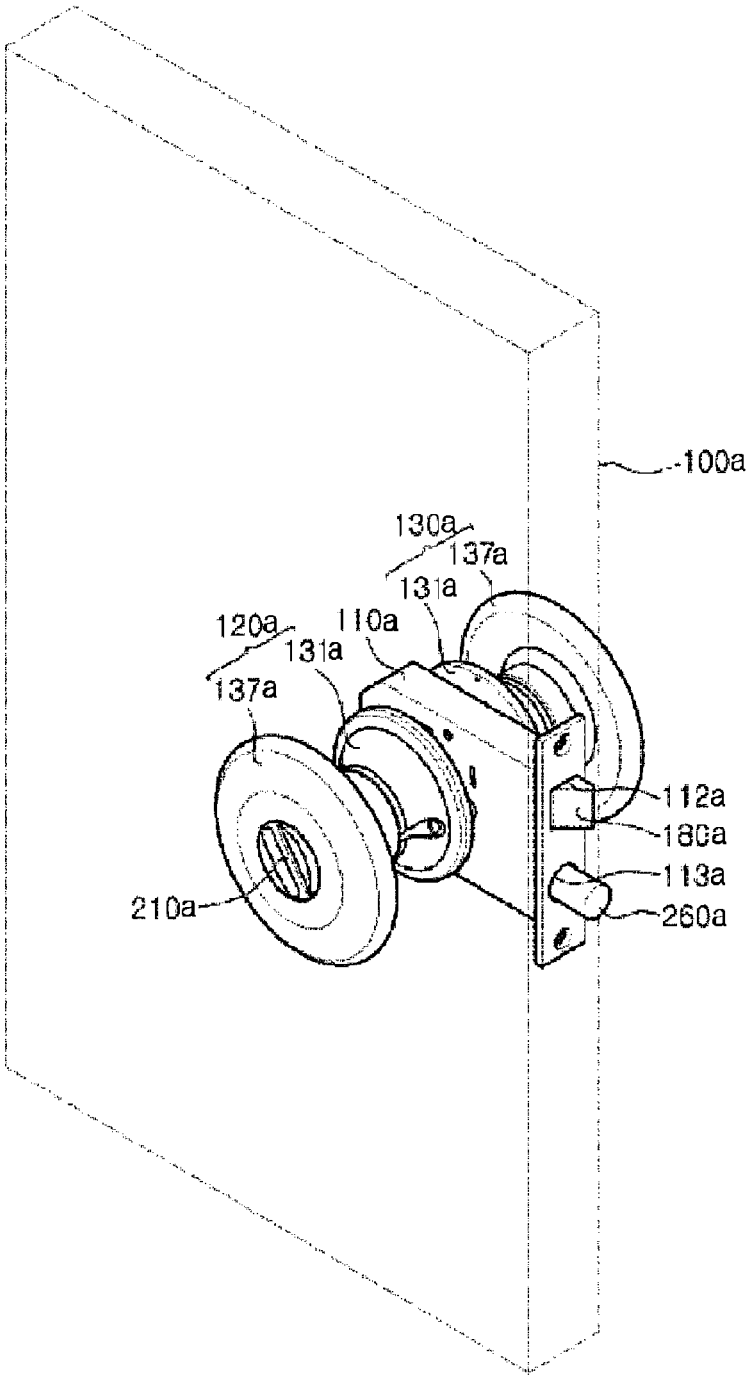
FIG. 9 is a perspective view showing the outer shape of an apparatus for opening and closing a front entrance, according to the present invention.
Figure 10:
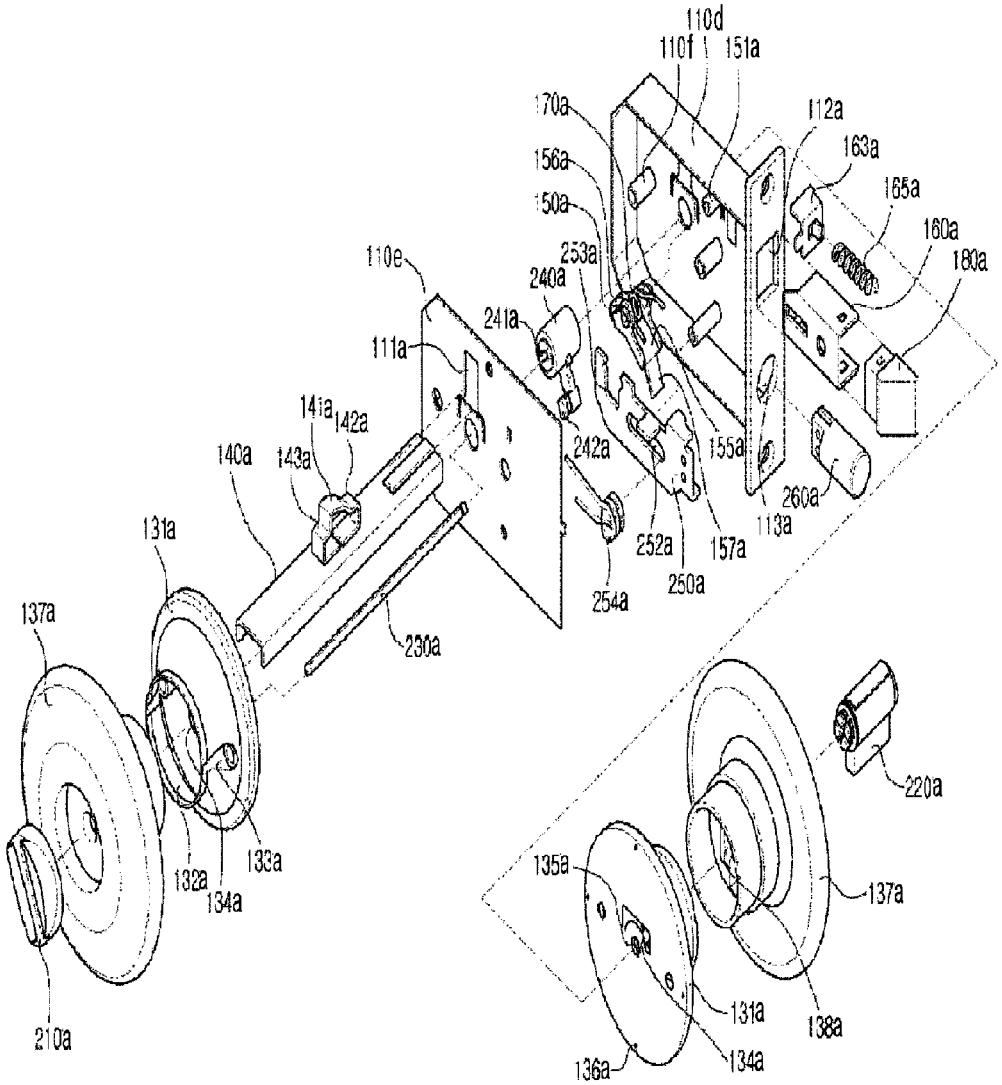
FIG. 10 is an exploded perspective view of the apparatus according to the present invention.
Figure 11:
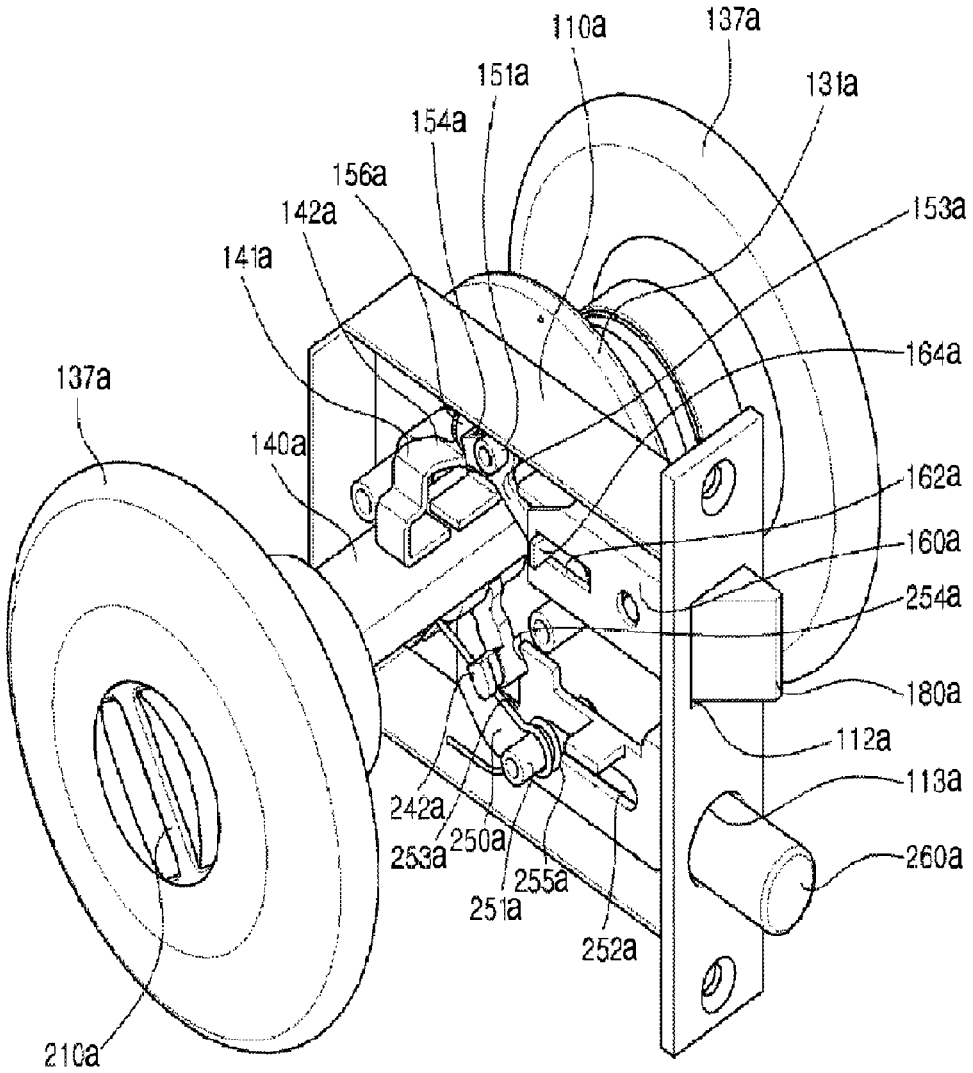
FIG. 11 is a perspective view illustrating critical parts of the apparatus according to the present invention.
Figure 12:
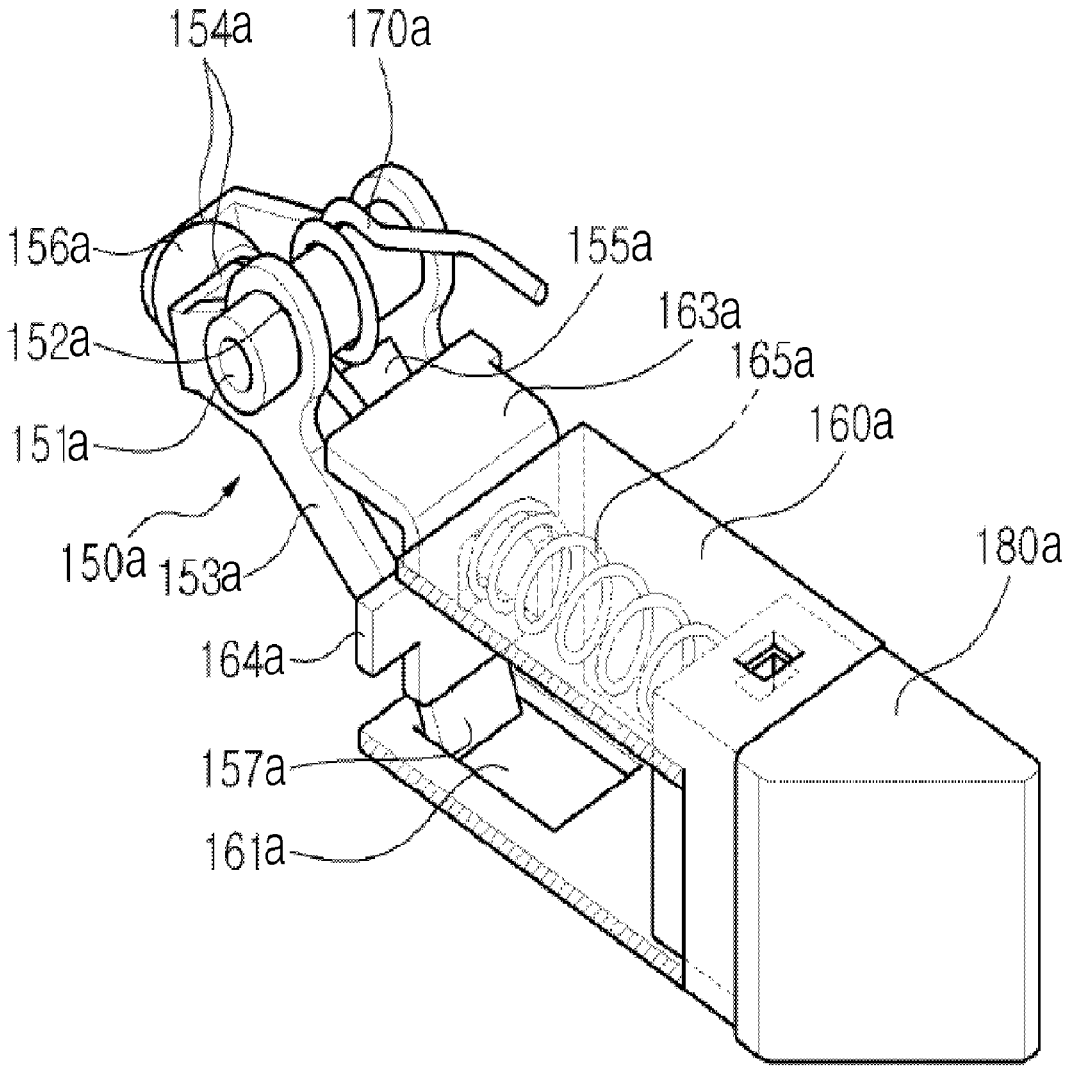
FIG. 12 is a view illustration a rotating unit and an actuating member of the apparatus according to the present invention.

FIG. 9 is a perspective view showing the outer shape of an apparatus for opening and closing a front entrance, according to the present invention. FIG. 10 is an exploded perspective view of the opening and closing apparatus according to the present invention. FIG. 11 is a perspective view illustrating critical parts of the opening and closing apparatus according to the present invention. FIG. 12 is a view illustrating a rotating unit and an actuating member of the opening and closing apparatus according to the present invention.

The apparatus for opening and closing the front entrance according to the present invention includes a first part which is used to embody the operation of opening or closing a door in such a way that when a handle is pushed or pulled the door opens, and when the handle is released the door closes, and a second part which is used to embody the operation of locking or unlocking the door in such a way as that a locking unit installed in the handle is rotated.

First, the first part which is used to embody the operation of opening or closing the door in such a way that when the handle is pushed or pulled the door opens, and when the handle is released the door closes will be described with reference to the attached drawings.

As shown in FIG. 9 through 12, the apparatus for opening and closing the front entrance according to the present invention includes a door lock housing 110*a*, first and second door handles 120*a* and 130*a*, a movable member 140*a*, a rotating unit 150*a*, an actuating member 160*a* and a restoring spring 170*a*.

The door lock housing 110*a* includes a main body 110*d* which is open on a surface thereof and receives the rotating unit 150*a* and the actuating member 160*a* therein, and a cover 110*e* which covers the open surface of the main body

110*d*. The main body 110*d* and the cover 110*e* are coupled to each other by a plurality of fasteners 110*f*.

The door lock housing 110*a* has a movable-member passing hole 111*a* which is formed in central portions of the cover 110*e* and the main body 110*d*. The door lock housing 110*a* has, in a side surface thereof, a first opening 112*a* in which a latch bolt 180*a* is retractably disposed, and a second opening 113*a* in which a dead bolt 260*a* is retractably disposed. The door lock housing 110*a* is installed in a door 100*a* in such a way that the first and second opening 112*a* and 113*a* are exposed to the outside from the side surface of the door 100*a*.

The first and second door handles 120*a* and 130*a* are respectively installed on first and second surfaces of the door 100*a* in which the door lock housing is installed.

Each of the door handles 120*a* and 130*a* includes a mounting bracket 131*a* which is coupled to the door 100*a*, and a grip part 137*a* which is inserted into the mounting bracket 131*a* and configured to be pushed and pulled.

The mounting bracket 131*a* has a receive space 132*a* in which a first end of the grip part 137*a* is disposed so as to be movable forwards and backwards. Guide holes 133*a* are formed in the mounting bracket 131*a* on opposite sides of the receiving space 132*a*. Communicating with the receiving space 132*a*, a hole 134*a* is formed in a central portion of a surface of the mounting bracket 131*a* that makes contact with the door 100*a*. A through hole 135*a* is formed in the mounting bracket 131*a* below the hole 134*a*. The hole 134*a* has the same shape as that of a movable member 140*a* so that the movable member 140*a* is inserted into the hole 134*a*. The through hole 135*a* has an appropriate size to dispose therein an actuating shaft 230*a* which will be explained in detail in the decription of the second part. A plurality of fixing protrusions 136*a*, each of which has a pointed shape, are provided around the hole 135*a* and the through hole 135*a* and pegged into the corresponding surface of the door 100*a*. Pegged into the surface of the door 100*a* that makes contact with the mounting bracket 131*a*, the fixing protrusions 136*a* function to fix the mounting bracket 131*a* in place.

A protrusion is provided on a central portion of a first surface of each grip part 137*a* and disposed in the receiving space 132*a* of the corresponding mounting bracket 131*a* so as to be movable forwards and backwards under guidance of the guide hole 133*a*. An insert depression 138*a* having the same shape as that of the hole 134*a* of the mounting bracket 131*a* is formed in the grip part 137*a*. Locking units 210*a* and 220*a* are respectively installed in the grip parts 137*a* at positions corresponding to the through holes 135*a* of the mounting brackets 131*a*. Each of the locking units 210*a* and 220*a* comprises a key assembly or a manipulation lever. In detail, each locking unit 210*a*, 220*a* is installed in the corresponding grip part 137*a* in such a way that a key insert slot of the key assembly or a manipulation surface of the manipulation lever is exposed to the outside through a second surface of the grip part 137*a* to allow a user to manipulate the locking unit 210*a*, 220*a*.

A first end of the movable member 140*a* which has a reverse U-shaped cross-section passes through the hole 134*a* formed in the mounting bracket 131*a* of the first door handle and is inserted into the insert depression 138*a* of the corresponding grip part. A second end of the movable member 140*a* passes through the through hole 111*a* formed in the door lock housing 110*a* and is inserted both into the hole 134*a* which is formed in the mounting bracket 131*a* of the second door handle and into the insert depression 138*a* of the corresponding grip part. A lift guide block 141*a* is provided on a medial portion of the movable member 140*a* so that a roller 156*a* is moved upwards under guidance of the lift guide block 141*a*. The lift guide block 141*a* has on a first end thereof an inclined surface 142*a* which is gently curved upwards from the first end to a medial portion of the lift guide block 141*a*. A second end of the lift guide block 141*a* is bent to have a stepped portion 143*a*.

The movable member 140*a* is horizontally moved by the operation of pushing or pulling the first or second door handle 120*a* or 130*a*.

The rotating unit 150*a* includes a pair of links 153*a* each of which has an L shape such that the principle of the lever can be used. A coupling hole 152*a* is formed in a bent portion of each L-shaped link 153*a*, and a rotation shaft 151*a* is disposed in the coupling holes 152*a* of the links 153*a*. The links 153*a* are rotatably provided on the rotation shaft 151*a* which is fixed in place in a longitudinal direction of the movable member 140*a*. A bent part 154*a* is formed by bending the first end of each link 153*a* such that the bent part 154*a* is parallel to the direction in which the lift guide block 141*a* moves. Second ends of the links 153*a* are connected to each other by a connection part 155*a*. The roller 156*a* is rotatably coupled to the bent parts 154*a* of the links 153*a*. Bent downwards, a locking stop 157 is connected to the connection part 155 of the links 153.

The rotating unit 150*a* having the above-mentioned construction is disposed in the door lock housing 110*a* above the movable member 140*a* in such a way that the roller 156*a* makes contact with the inclined surface 142*a* of the lift guide block 141*a*.

Therefore, when the movable member 140*a* horizontally moves in a predetermined direction, the roller 156*a* of the rotating unit 150*a* is moved upwards along the inclined surface of the lift guide block 141*a*. Simultaneously, the locking stop 157*a* is moved downwards. That is, the rotating unit 150*a* rotates around the rotation shaft 151*a* because of the links 153*a* that use the principle of the lever.

The actuating member 160*a* has a hollow structure. A locking slot 161*a* is formed in the bottom surface of a first end of the actuating member 160*a*. A guide slot 162*a* is formed in a sidewall of the actuating member 160*a*. The locking stop 157*a* of the rotating unit is disposed in the locking slot 161*a* of the actuating member and locked to an end of the locking slot 161*a*. Limiting the reverse rotation of the locking stop 157*a*, a stopper 163*a* is provided on the actuating member 160*a* above the locking slot 161*a*. The stopper 163*a* has a protrusion 164*a* which is fixed to the sidewall of the door lock housing 110*a* through the guide slot 162*a* of the actuating member. Thus, the stopper 163*a* functions not only to limit the reverse rotation of the locking stop 157*a*, but also to guide the actuating member 160*a* such that the actuating member 160*a* can be reliably moved to the left or right. An elastic spring 165*a* is provided in the actuating member 160*a* between the stopper 163*a* and a portion of the actuating member 160*a*. The elastic spring 165*a* elastically supports the actuating member 160*a* so that when no external force is applied to the actuating member 160*a*, the actuating member 160*a* can return to its original position. A second end of the actuating member 160*a* is coupled to the latch bolt 180*a* which is disposed in the first opening 112*a* of the door lock housing 110*a*.

When the rotating unit 150*a* is rotated, the actuating member 160*a* interlocked with the locking stop 157*a* is moved in a direction of the rotation of the rotating unit 150*a*. That is, the actuating member 160*a* is moved in a direction perpendicular to the direction in which the movable member 140*a* moves. In addition, the latch bolt 180*a* coupled to the actuating member 160*a* is ejected outwards from the door 100*a* or retracted thereinto.

The restoring spring 170*a* is wrapped around the rotation shaft 151*a* of the rotating unit 150*a*.

The restoring spring 170*a* is wrapped around the rotation shaft 151*a*. A first end of the restoring spring 170*a* is fixed to the inner surface of the door lock housing 110*a*, and a second end thereof is fixed to the links 153*a* at a position adjacent to the locking stop 157*a*. Therefore, the restoring spring 170*a* is expanded by rotation of the links 153*a*, and when the external force that has rotated the links 153*a* is removed, the restoring spring 170*a* returns to its original state so that the links 153*a* can be returned to their pre-rotated state. The operation of the opening and closing apparatus having the above-mentioned construction will be described in detail.

Figure 13:
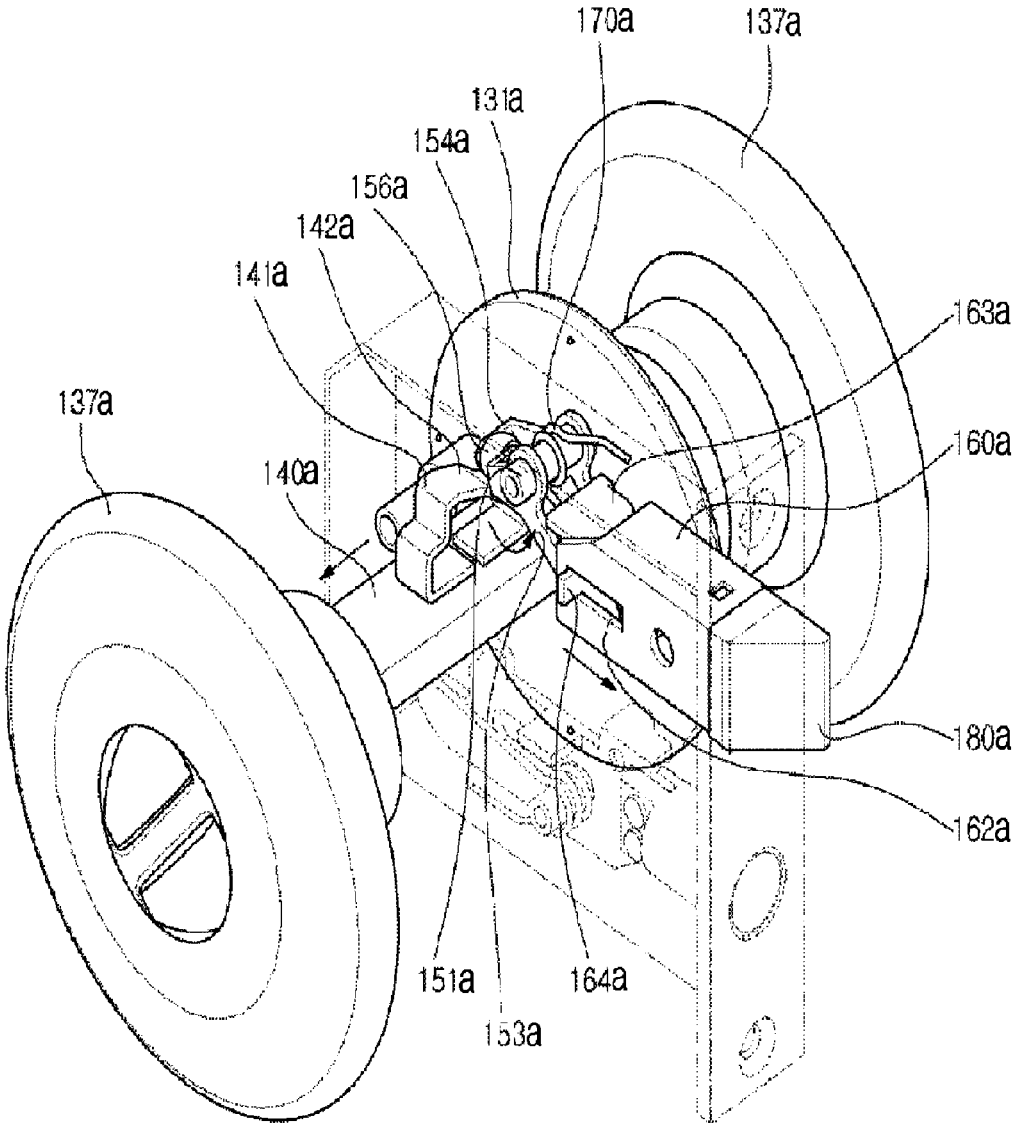
FIG. 13 is a view illustrating a door opening operation of the apparatus according to the present invention.
Figure 14:
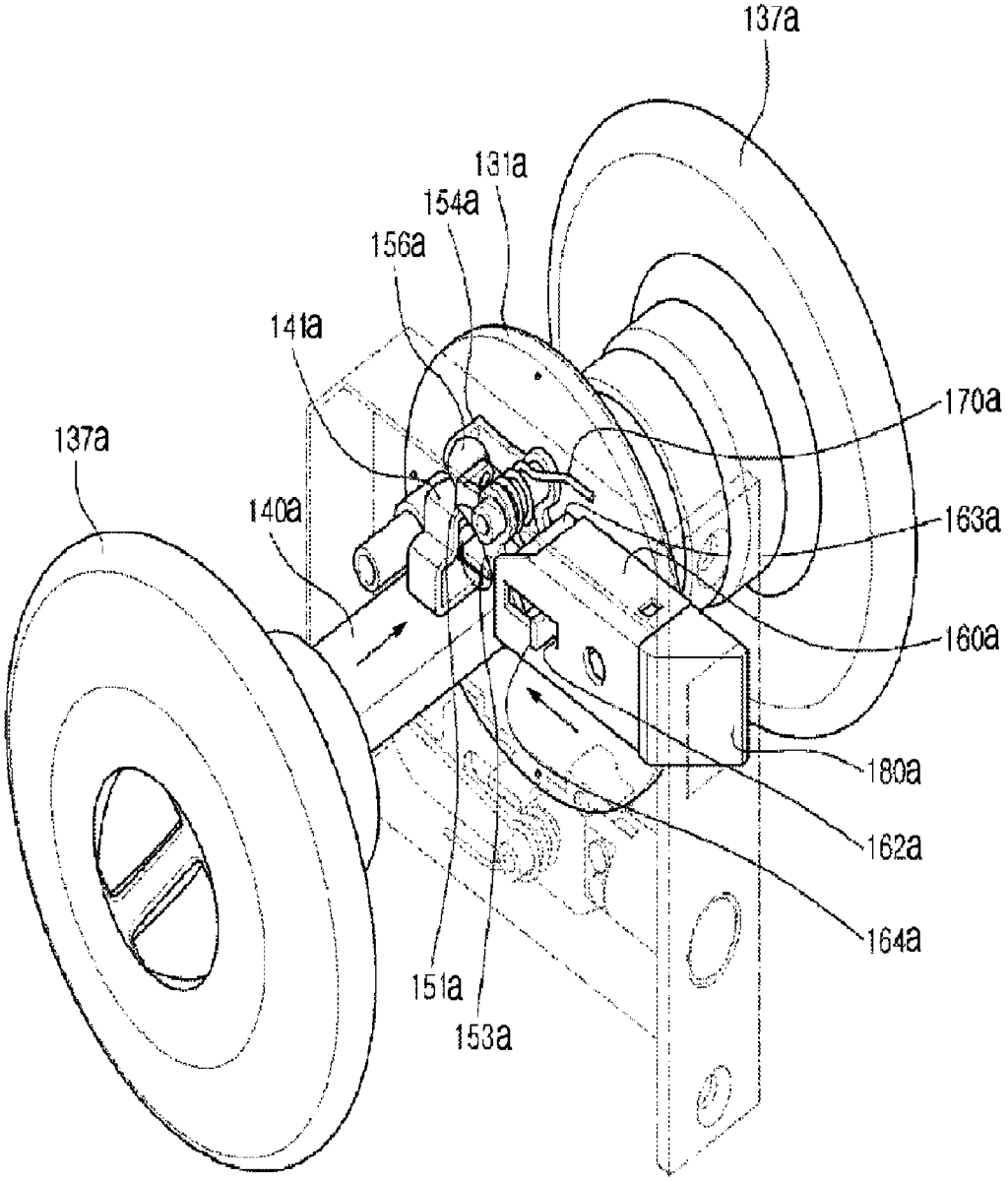
FIG. 14 is a view illustrating a door closing operation of the apparatus according to the present invention.

FIG. 13 is a view illustrating a door closing operation of the apparatus according to the present invention. FIG. 14 is a view illustrating a door opening operation of the apparatus according to the present invention. In FIGS. 13 and 14, for the convenience of understanding, only the components that are used to embody the function of the first part are illustrated by solid lines. The operation of the first part can be conducted after the door has been unlocked.

In the state of FIG. 13, external force is applied to neither the first nor second door handle 120*a* and 130*a*, so that the restoring spring 170*a* is normally released and a front end of the latch bolt 180*a* is ejected outwards from the first opening 112*a*.

As shown in FIG. 6, when the grip part 137*a* which is provided in the first or second door handle is pushed or pulled, the movable member 140*a* is horizontally moved, and the lift guide block 141*a* provided on the upper surface of the movable member 140*a* is integrally moved along with the movable member 140*a*. At this time, the lift guide block 141*a* pushes the roller 156*a* that makes contact with the inclined surface 142*a*. Then, the roller 156*a* rotates on the hinge and rolls upwards along the inclined surface 142*a* of the lift guide block 141*a* from the bottom of the inclined surface 142*a* to the top thereof. As the roller 156*a* moves upwards, the locking stop 157*a* is moved by the rotation of the links 153*a* that use the principle of the lever. As moving downwards, the locking stop 157*a* is completely locked to the locking slot 161*a* of the actuating member 160*a* and rotated around the rotation shaft 151*a*, thus moving the actuating member 160*a* in the direction corresponding to the direction in which the locking stop 157*a* rotates. Here, because the protrusion 164*a* of the stopper that is fixed to the door lock housing 110*a* through the guide slot 162*a* of the actuating member 160*a* guides the movement of the actuating member 160*a*, the actuating member 160*a* can be reliably moved in the direction perpendicular to the direction in which the movable member 140*a* moves. The latch bolt 180*a* coupled to the actuating member 160*a* is retracted into the first opening 112*a* by the movement of the actuating member 160*a*, and the door 100*a* thus opens. During the above process, the restoring spring 170*a* wrapped around the rotation shaft 151*a* is expanded by the rotation of the rotating unit 150*a*, and the elastic spring 165*a* installed in the actuating member 160*a* is compressed.

Meanwhile, as shown in FIG. 14, when the grip part 137*a* of the first or second door handle that has been pushed or pulled is released 10, in other words, when the external force that has been applied to the grip part 137*a* is removed, the restoring spring 170*a* that has expanded returns to its original state, thus returning the links 153*a* of the rotating unit 150*a* to the pre-rotated state. As the links 153*a* return to their original state, the locking stop 157*a* is moved upwards whereby the actuating member 160*a* that has been pulled by the locking stop 157*a* is released therefrom. The actuating member 160*a* released from the locking stop 157*a* is returned to its original position by the restoring force of the elastic spring 165*a*. Thereby, the latch bolt 180*a* that has been retracted into the first opening 112*a* is ejected outwards from the first opening 112*a* by the movement of the actuating member 160*a* so that the door 100*a* enters the closed state of FIG. 13.

In the above-mentioned opening and closing apparatus, when the user pushes the grip part 137*a* of the door handle in the direction in which the door 100*a* opens, the movable member 140*a* is pushed by the pushing force of the grip part 137*a*. Here, until the lift guide block 141*a* of the movable member 140*a* begins to push the roller 156*a* upwards, the grip part 137*a* is easily pushed. While the lift guide block 141*a* pushes the roller 156*a* upwards and the roller 156*a* thus rolls upwards along the inclined surface of the lift guide block 141*a*, the speed at which the grip part 137*a* is pushed and moved is reduced. Therefore, the user can feel in his or her hand a variation of the speed of the grip part 137*a*, that is, a reduction in the speed at which the grip part 137*a* is pushed. Thus, the user can sense that the door 100*a* is opening. In addition, by virtue of the rolling motion of the roller 156*a* that moves upwards along the inclined surface 142*a* of the lift guide block, the user may not only be able to sense that the door 100*a* is opening but the door 100*a* opens smoothly.

Hereinafter, the second part which is used to embody the operation of locking or unlocking the apparatus for opening and closing the front entrance in such a way that the opening and closing apparatus can be simply locked indoors or outdoors and, as needed, the locked state of the opening and closing apparatus can be released will be described with reference to the attached drawings.

As shown in FIGS. 1 through 3, the apparatus for opening and closing the front entrance according to the present invention further includes first and second locking units 210*a* and 220*a*, an actuating shaft 230*a*, a rotating lever 240*a*, an opening and closing member 250*a* and a dead bolt 260*a*. The first and second locking units 210*a* and 220*a* are respectively installed in the first and second door handles 120*a* and 130*a*. The actuating shaft 230*a* passes through the door lock housing 110*a*. A first end of the actuating shaft 230*a* is connected to the first locking unit 210*a* and a second end thereof is connected to the second locking unit 220*a*. The actuating shaft 230*a* is rotated to the left or right by the operation of the first or second locking unit 210*a* or 220*a*. The rotating lever 240*a* is coupled to the actuating shaft 23*a*0, disposed in the door lock housing 110*a*, and rotated to the left or right by the rotation of the actuating shaft 230*a*. The opening and closing member 250*a* is rotated to the left or right in conjunction with the rotation of the rotating lever 240*a*. A first end of the dead bolt 260*a* is connected to the opening and closing member 250*a* and a second end of the dead bolt 260*a* is disposed in the second opening 113*a* formed in the side surface of the door lock housing 110*a*.

Each of the first and second locking units 210*a* and 220*a* comprises a key assembly into which a key is inserted or manipulation lever. In detail, each of the first and second locking units 210*a* and 220*a* is installed in the corresponding door handle 120*a*, 130*a* in such a way that a key insert slot of the key assembly or a manipulation surface of the manipulation lever is exposed to the outside through a first surface of the door handle 120*a*, 130*a* to allow the user to manipulate the first or second locking unit 210*a* or 220*a*.

The actuating shaft 230*a* which has a rectangular cross-section is disposed both in a central portion of the rotating lever 240*a* and in the through holes 135*a* of the mounting brackets 131*a* and coupled to the first and second locking units 210*a* and 220*a* installed in the grip parts 137*a*.

The rotating lever 240*a* has in a central portion thereof a rectangular hole 241*a* in which the actuating shaft 230*a* is disposed. A protruding piece 242*a* for use in moving the opening and closing member 250*a* is provided on an end of the rotating lever 240*a*. A guide groove 243*a* is formed in an outer surface of the protruding piece 242*a*. Because of the actuating shaft 230*a* and the hole 241*a* of the rotating lever 240*a* are rectangular, the rotating lever 240*a* can be rotated along with the actuating shaft 230*a*.

The opening and closing member 250*a* is disposed below the rotating lever 240*a*. A first end of the opening and closing member 250*a* is coupled to the dead bolt 260*a* which is disposed in the second opening 113*a* of the door lock housing 110*a*. Extending a predetermined length in the longitudinal direction of the opening and closing member 250*a*, a guide hole 252*a* is formed in a central portion of the opening and closing member 250*a*. Protruding from the inner surface of door lock housing 110*a*, a support pin 252*a* is disposed in the guide hole 252*a*. A locking depression 253*a* to which the protruding piece 242*a* of the rotating lever 240*a* is locked is formed at a predetermined position in an upper edge of the opening and closing member 250*a*. Locking notches 254*a* are respectively formed in opposite side edges of the locking depression 253*a* so that, when rotated to the maximum, the protruding piece 242*a* is locked to the corresponding locking notch 254*a*. A tension spring 255*a* which elastically supports the protruding piece 242*a* of the rotating lever 240*a* is wrapped around the support pin 252*a*. Wrapped around the support pin 252*a*, the tension spring 255*a* is fixed at a first end thereof to the bottom surface of the door lock housing 110*a* and fixed at a second end thereof to the sidewall of the door lock housing 110*a* via a lower surface of the guide groove 243*a* of the rotating lever 240*a*.

The operation of the second part of the opening and closing apparatus having the above-mentioned construction will be explained in detail.

Figure 15:
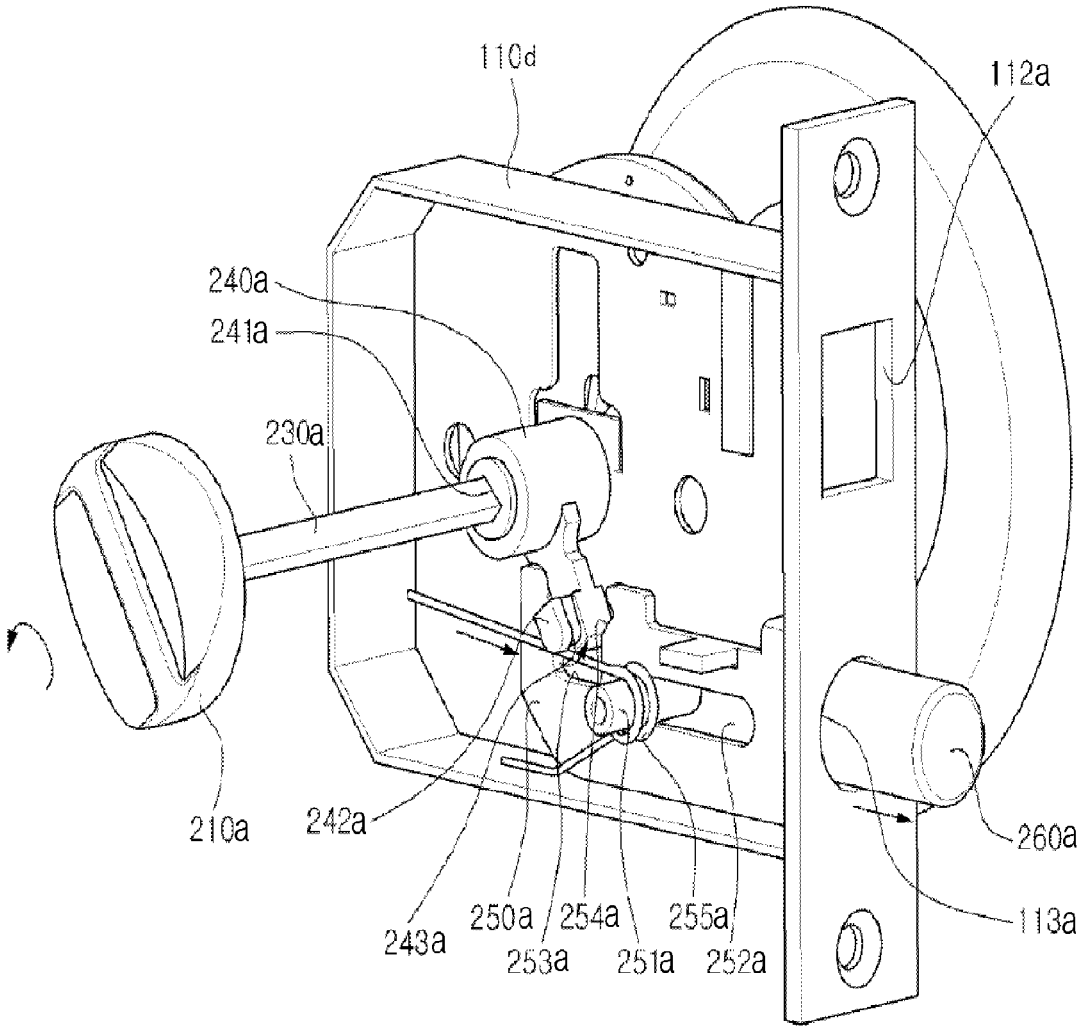
FIG. 15 is a view illustrating a locked state of the opening and closing apparatus according to the present invention.
Figure 16:
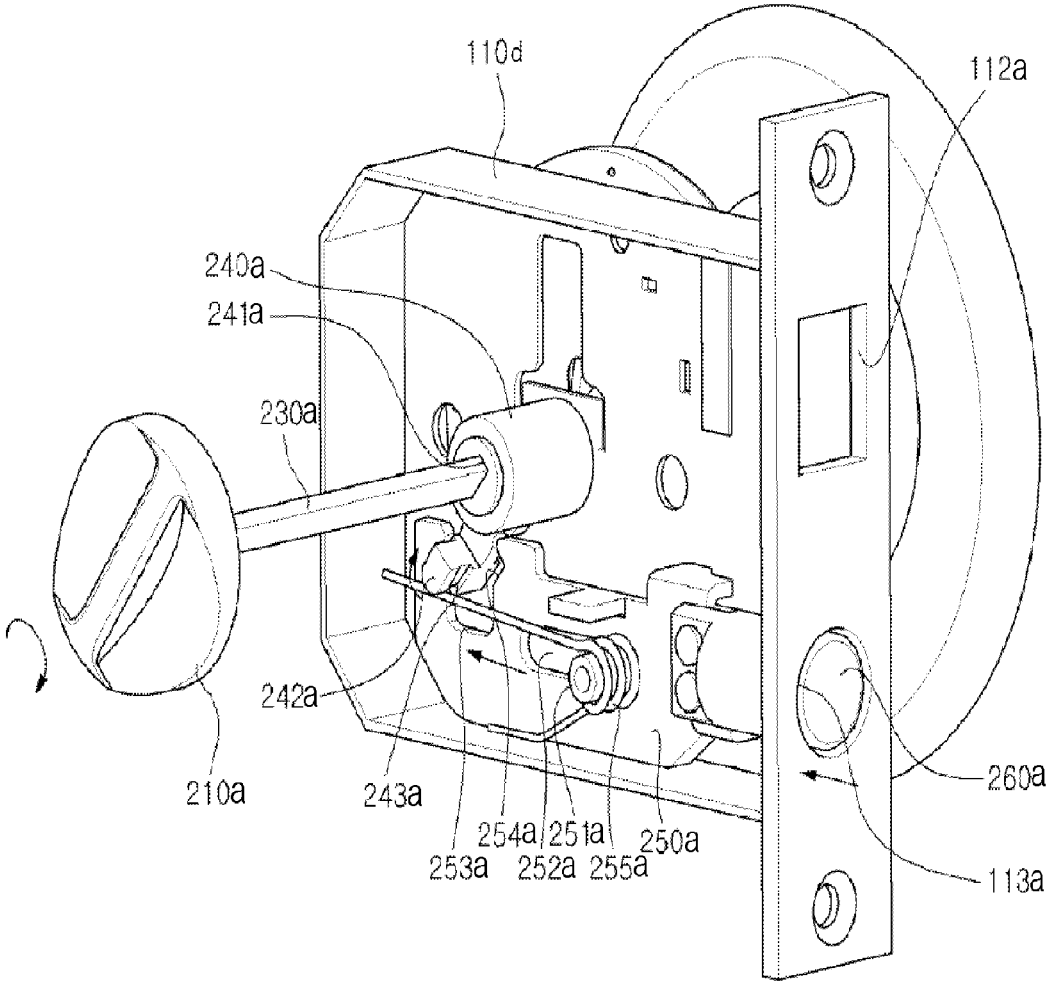
FIG. 16 is a view illustrating an unlocked state of the opening and closing apparatus according to the present invention.

FIG. 15 is a view illustrating the locked state of the opening and closing apparatus according to the present invention. FIG. 16 is a view illustrating the unlocked state of the opening and closing apparatus according to the present invention. In FIGS. 15 and 16, for the convenience of understanding, only the components that are used to embody the function of the second part are illustrated.

As shown in FIG. 15, to lock the door 100*a* and thus prevent the door 100*a* from opening, the dead bolt 260*a* of the opening and closing apparatus must be ejected outwards from the outer surface of the door 100*a*.

In this state, as shown in FIG. 16, to make the door 100 enter an openable state, the key is inserted into the first or second locking unit 210*a* or 220*a* provided in the first or second door handle 110*a* or 120*a* and rotated in a predetermined direction, or the manipulation lever is rotated in a predetermined direction. Then, the actuating shaft 230*a* which is integrally coupled to the first and second locking units 210*a* and 220*a* is rotated. The rotating lever 240*a* is rotated in the same direction by the rotation of the actuating shaft 230*a*. Simultaneously, the protruding piece, which is provided on the end of the rotating lever 240*a* and disposed in the locking depression 253*a* of the opening and closing member 250*a*, is also rotated, thus moving the opening and closing member 250*a* in a direction corresponding to the rotation of the protruding piece 242*a*. Here, because the support pin 252*a* fixed to the door lock housing 110*a* is disposed in the guide hole 251*a* of the opening and closing member 250*a*, the opening and closing member 250*a* is linearly moved under the guidance of the support pin 252*a*. When the protruding piece 242*a* that has rotated is locked to the locking notch 254*a* formed in a first side edge of the locking depression 253*a*, the rotating lever 240*a* no longer rotates. Furthermore, in this case, the protruding piece 242*a* of the rotating lever 240*a* is supported by the elastic force of the tension spring 255*a*. The rotating lever 240*a* is therefore prevented from being reversely rotated, unless external force is applied thereto. Consequently, the opening and closing member 250*a* that has been moved to the door openable state can be maintained in place. The dead bolt 260*a* coupled to the opening and closing member 250*a* is retracted into the second opening 113*a* by the movement of the opening and closing member 250*a*, thus allowing opening of the door 100*a*.

Meanwhile, to lock the door 100*a* and thus prevent the door 100*a* from opening, the key is inserted into the first or second locking unit 210*a* or 220*a* and reversely rotated or the manipulation lever is reversely rotated. Then, the actuating shaft 230*a* and the rotating lever 240*a* which are integrally coupled to the first and second locking units 210*a* and 220*a* are reversely rotated. Simultaneously, the protruding piece 242*a*, which is disposed in the locking depression 253*a* of the opening and closing member 250*a*, is also reversely rotated by the rotation of the rotating lever 240*a*, thus moving the opening and closing member 250*a* in a direction corresponding to the direction in which the protruding piece 242*a* rotates. During the above process, because the support pin 252*a* fixed to the door lock housing 110*a* is disposed in the guide hole 251*a* of the opening and closing member 250*a*, the opening and closing member 250*a* can also linearly move under the guidance of the support pin 252*a*. When the protruding piece 242*a* that has reversely rotated is locked to the locking notch 254*a* formed in a second side edge of the locking depression 253*a*, the protruding piece 242*a* no longer rotates. Furthermore, because the protruding piece 242*a* of the rotating lever 240*a* moves the opening and closing member 250*a* while overcoming the elastic force of the tension spring 255*a* that elastically supports the protruding piece 242*a*, the rotation of the rotating lever 240*a* and the movement of the opening and closing member 250*a* can be reliably and smoothly embodied. The dead bolt 260*a* coupled to the opening and closing member 250*a* is ejected outwards form the second opening 113*a* by the movement of the opening and closing member 250*a* and inserted into a locking recess (not shown) formed in the side frame of the entrance, so that the door enters the closed state of FIG. 15.

As described above, in the apparatus for opening and closing the front entrance according to the present invention, when a user pushes or pulls a door handle of the door after unlocking a door, he or she can easily sense that the door is opening while feeling both variation of the speed of the door handle when a roller begins to move upwards and the rolling motion of the roller, whereby the safety in opening or closing the door can be enhanced. Furthermore, the operation of opening the door can be smoothly conducted by the rolling motion so that the convenience in use can be enhanced.

In addition, the opening and closing apparatus is operated in a pushing or pulling fashion rather than in a rotating fashion. Therefore, even children, the elderly and disabled persons, or a user who is using both hands to hold objects, can easily open the door. Thus, convenience in use and practicality can be improved.

Moreover, the operation of locking or unlocking the opening and closing apparatus can be facilitated, so that there is no possibility of failure of the apparatus in locking or unlocking the locking unit, and the reliability can be enhanced by virtue of the increased precision of the locking units.

Furthermore, the opening and closing apparatus is operated in a pushing or pulling fashion rather than in a rotating fashion. Therefore, for places such as public offices or venues which are crowded, an accident can be prevented because it is easy to open the door. Particularly, in case of a fire, if a handle of the door melts in the fire, it may be impossible to rotate the door handle. However, in the present invention, because the apparatus can be easily operated in a pushing fashion, the risk of an accident can be markedly reduced.

Although the preferred embodiments of the present invention have been disclosed for illustrative purposes, the present invention is not limited to these embodiments. Those skilled in the art will appreciate that various modifications, additions and substitutions are possible, without departing from the scope and spirit of the invention as disclosed in the accompanying claims. These modification, additions and substitutions must be regarded as being equivalents falling within the bounds of the present invention.

We claim:

1. An apparatus for opening and closing an entrance, comprising:

a door lock housing having in a side surface thereof a first opening in which a latch bolt is disposed, the door lock housing being installed in a door in such a way that the first opening is exposed out of an outer surface of the door;

a first and a second door handle respectively provided on a first and a second surface of the door, each of the first and second door handles being configured to be pushed or pulled;

a movable member disposed in the door lock housing and coupled at respective opposite ends thereof to the first and second door handles, the movable member being horizontally moved by pushing or pulling either the first door handle or the second door handle, with a lift guide block provided on a medial portion of an upper surface of the movable member, the lift guide block guiding upward movement of a roller;

a rotating unit disposed across an upper surface of the movable member, the rotating unit being coupled at a first end thereof to a hinge shaft, with the roller provided in a lower surface of a medial portion of the rotating unit, the roller making contact with the lift guide block, the rotating unit including a bent part on a second end thereof, wherein when the movable member is horizontally moved, the rotating unit is rotated around the hinge shaft by the roller moving upwards along the lift guide block;

a latch bolt coupling unit locked at a first end thereof to the bent part of the rotating unit and coupled at a second end thereof to the latch bolt disposed in the first opening, the latch bolt coupling unit being moved to leftwards or rightwards depending on a direction of the rotation of the rotating unit;

a restoring spring wrapped around the hinge shaft, the restoring spring fixed at a first end thereof to an inner surface of the door lock housing and fixed at a second end thereof to the rotating unit so that the rotating unit is returned to an original state thereof by the restoring spring;

a first and a second locking unit respectively installed in the first and second door handles;

an actuating shaft disposed in the door lock housing, the actuating shaft coupled at a first end thereof to the first locking unit and coupled at a second end thereof to the second locking unit so that the actuating shaft is rotated leftwards or rightwards by manipulating the first or the second locking unit;

a rotating lever coupled to the actuating shaft and disposed in the door lock housing, the rotating lever being rotated leftwards or rightwards by the rotation of the actuating shaft;

an opening and closing member moved leftwards or rightwards in conjunction with the rotation of the rotating lever; and a dead bolt coupled at a first end thereof to the opening and closing member, the dead bolt being disposed at a second end thereof in a second opening formed in the side surface of the door lock housing.

2. The apparatus of claim 1, wherein the lift guide block includes an inclined surface having an upwardly curved shape so that the roller rolls on the inclined surface and moves upwards.

3. The apparatus of claim 1, wherein until the lift guide block of the movable member begins to push the roller, the first and second door handles are easily pushed or pulled, and when the lift guide block pushes the roller so that the roller rolls and moves upwards along the inclined surface of the lift guide block, a speed at which the first and second door handles are pushed or pulled is reduced.

4. The apparatus of claim 1, wherein each of the first and second door handles comprises:

a mounting bracket fixed to a corresponding one of the first and second surfaces of the door, the mounting bracket having a receiving space in which a first end of a grip part is disposed so as to be movable forwards or backwards; and the grip part inserted at the first end thereof into the receiving space of the mounting bracket, the grip part being configured to be pushed or pulled.

5. The apparatus of claim 1, wherein the rotating unit comprises:

a pair of links having in a first end thereof a hinge coupling hole, with the bent part provided on a second end of the pair of links, the bent part being bent at a predetermined position to have a downward inclined surface extending from a first end of the bent part to the predetermined position and an upward inclined surface extending from the predetermined position to a second end of the bent part;

the hinge shaft coupled to the hinge coupling hole of the pair of links spaced apart from each other by a predetermined distance;

a connection part connecting medial portions of the pair of links to each other, with coupling surfaces bent downwards from respective opposite ends of the connection part; and the roller coupled to the coupling surfaces of the connection part by a hinge.

6. The apparatus of claim 5, wherein a roller pin is provided on an outer surface of the first end of the latch bolt coupling unit and placed on the bent part of the pair of links of the rotating unit so as to be movable along the inclined surface of the bent part.

7. The apparatus of claim 1, wherein the actuating shaft has a rectangular cross-section, and the rotating lever has in a central portion thereof a rectangular hole into which the actuating shaft is fitted so that when the actuating shaft rotates, the rotating lever is rotated along with the actuating shaft.

8. The apparatus of claim 1, wherein the opening and closing member has:

a guide slot in a central portion thereof, the guide slot extending a predetermined length in a longitudinal direction of the opening and closing member, with a support pin disposed in the guide slot, the support pin protruding from an inner surface of the door lock housing;

a locking depression formed at a predetermined position in an upper edge of the opening and closing member so that the rotating lever is locked to the locking depression; and locking notches respectively formed in opposite side edges of the locking depression so that the rotating lever, when rotating, is locked to either of the locking notches and prevented from being removed from the locking depression.

9. The apparatus of claim 8, wherein a tension spring is wrapped around the support pin, the tension spring elastically supporting the rotating lever.

10. The apparatus of claim 1, wherein each of the first and second locking units comprises a key assembly into which a key is inserted, or a manipulation lever.

11. An apparatus for opening and closing an entrance, comprising:

a door lock housing having in a side surface thereof a first opening in which a latch bolt is disposed, the door lock housing being installed in a door in such a way that the first opening is exposed out of an outer surface of the door;

a first and a second door handle respectively provided on a first and a second surface of the door lock housing, each of the first and second door handles being configured to be pushed or pulled;

a movable member disposed in the door lock housing and coupled at respective opposite ends thereof to the first and second door handles, the movable member being horizontally moved by pushing or pulling either the first door handle or the second door handle, with a lift guide block provided on a medial portion of an upper surface of the movable member, the lift guide block guiding upward movement of a roller;

a rotating unit coupled at a medial portion thereof to a rotation shaft, the rotation shaft fixed in place and oriented in a direction parallel to the movable member, with the roller provided in a first end of the rotating unit, the roll making contact with the lift guide block, and with a locking stop provided on a second end of the rotating unit, wherein when the movable member is horizontally moved, the rotating unit is rotated around the rotation shaft;

an actuating member locked at a first end thereof to the locking stop of the rotating unit and coupled at a second end thereof to the latch bolt disposed in the first opening, the actuating member being moved to leftwards or rightwards depending on a direction of the rotation of the rotating unit;

a restoring spring wrapped around the rotation shaft of the rotating unit, the restoring spring fixed at a first end thereof to an inner surface of the door lock housing and fixed at a second end thereof to the second end of the rotating unit so that the rotating unit is returned to an original state thereof by the restoring spring;

a first and a second locking unit respectively installed in the first and second door handles;

an actuating shaft disposed in the door lock housing, the actuating shaft coupled at a first end thereof to the first locking unit and coupled at a second end thereof to the second locking unit so that the actuating shaft is rotated leftwards or rightwards by manipulating the first or second locking unit;

a rotating lever coupled to the actuating shaft and disposed in the door lock housing, the rotating lever being rotated leftwards or rightwards by the rotation of the actuating shaft;

an opening and closing member moved leftwards or rightwards in conjunction with the rotation of the rotating lever; and a dead bolt coupled at a first end thereof to the opening and closing member, the dead bolt being disposed at a second end thereof in a second opening formed in the side surface of the door lock housing.

12. The apparatus of claim 11, wherein the lift guide block includes an inclined surface having an upwardly curved shape so that the roller rolls on the inclined surface and moves upwards.

13. The apparatus of claim 11, wherein until the lift guide block of the movable member begins to push the roller, the first and second door handles are easily pushed or pulled, and when the lift guide block pushes the roller so that the roller rolls and moves upwards along the inclined surface of the lift guide block, a speed at which the first and second door handles are pushed or pulled is reduced.

14. The apparatus of claim 11, wherein each of the first and second door handles comprises:

a mounting bracket fixed to a corresponding one of the first and second surfaces of the door, the mounting bracket having a receiving space in which a first end of a grip part is disposed so as to be movable forwards or backwards; and the grip part inserted at the first end thereof into the receiving space of the mounting bracket, the grip part being configured to be pushed or pulled.

15. The apparatus of claim 11, wherein the rotating unit comprises: a pair of links spaced apart from each other by a predetermined distance, with a coupling hole formed in a medial portion of each of the links so that the links are coupled to the rotation shaft through the coupling holes; bent parts respectively provided on the first ends of the links and bent in a direction parallel to a direction in which the lift guide block moves, with the roller coupled to the bent parts by a hinge; and a connection part connecting the second ends of the links to each other, with the locking stop connected to the connection part, the locking stop being bent downwards.

16. The apparatus of claim 11, wherein the actuating member has: a locking slot formed in a bottom surface of a first end of the actuating member so that the locking stop of the rotating unit is locked to the locking slot; and guide slots formed in respective opposite side surfaces of the actuating member, with a stopper coupled to the guide slots, the stopper being used in limiting rotation of the locking stop.

17. The apparatus of claim 11, wherein the actuating shaft has a rectangular cross-section, and the rotating lever has in a central portion thereof a rectangular hole into which the actuating shaft is fitted so that when the actuating shaft rotates, the rotating lever is rotated along with the actuating shaft.

18. The apparatus of claim 11, wherein the opening and closing member has:

a guide slot in a central portion thereof, the guide slot extending a predetermined length in a longitudinal direction of the opening and closing member, with a support pin disposed in the guide slot, the support pin protruding from an inner surface of the door lock housing;

a locking depression formed at a predetermined position in an upper edge of the opening and closing member so that the rotating lever is locked to the locking depression; and locking notches respectively formed in opposite side edges of the locking depression so that the rotating lever, when rotating, is locked to either of the locking notches and prevented from being removed from the locking depression.

19. The apparatus of claim 18, wherein a tension spring is wrapped around the support pin, the tension spring elastically supporting the rotating lever.

20. The apparatus of claim 11, wherein each of the first and second locking units comprises a key assembly into which a key is inserted, or a manipulation lever.

* * * * *